US005464731A

United States Patent [19]

Ohki et al.

[11] Patent Number: 5,464,731

[45] Date of Patent: Nov. 7, 1995

[54] SILVER HALIDE COLOR PHOTOGRAPHIC MATERIAL

[75] Inventors: Nobutaka Ohki; Naoki Asanuma; Osamu Takahashi, all of Minami Ashigara, Japan

[73] Assignee: Fuji Photo Film Co., Ltd., Kanagawa, Japan

[21] Appl. No.: 203,400

[22] Filed: Mar. 1, 1994

[30] Foreign Application Priority Data

Mar. 1, 1993 [JP] Japan ..... 5-039813

[51] Int. Cl.[6] ..... G03C 1/46

[52] U.S. Cl. ..... 430/505; 430/551; 430/558; 430/372

[58] Field of Search ..... 430/505, 551, 430/372, 558

[56] References Cited

U.S. PATENT DOCUMENTS

| | | | |
|---|---|---|---|
| 2,728,659 | 12/1955 | Loria et al. | 430/551 |
| 4,587,210 | 5/1986 | Ono et al. | 430/551 |
| 4,945,034 | 7/1990 | Tanji et al. | 430/546 |
| 5,208,140 | 5/1993 | Nishijima et al. | 430/551 |
| 5,270,158 | 12/1993 | Nakatsugawa et al. | 430/551 |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide color photographic material comprising a support provided thereon at least one light sensitive silver halide emulsion layer and at least one light insensitive layer, wherein the light insensitive layer contains at least one of the compounds represented by Formula (I) and at least one of the compounds represented by Formula (II); and the amount of the compounds represented by Formula (II) in the above light insensitive layer is 15 to 100 mole % of the amount of the compounds represented by Formula (I) in the same light insensitive layer:

(I)

(II)

wherein $R_1$, $R_2$, $R_3$, and $R_4$ each represent an alkyl group, provided that a total of carbon numbers of $R_1$ and $R_2$ and a total of carbon numbers of $R_3$ and $R_4$ each are 16 or more and 60 or less and that a hydroquinone structure is not involved in $R_1$, $R_2$, $R_3$, and $R_4$.

20 Claims, No Drawings

SILVER HALIDE COLOR PHOTOGRAPHIC MATERIAL

FIELD OF THE INVENTION

The present invention relates to a silver halide color photographic material, more specifically to a silver halide color photographic material which is improved in background and gradation and has less degradation in a processing solution performance even during continuous processing.

BACKGROUND OF THE INVENTION

In a color photographic light-sensitive material of a type which contains a dye-forming coupler in a light-sensitive silver halide emulsion layer and is developed in a color developing solution containing an aromatic primary amine developing agent, a technique for improving background and a technique for controlling gradation are important for controlling image quality. In particular, with respect to an improvement in the background (color fog prevention), methods using various hydroquinones are known. There are known as these hydroquinones, mono-linear alkyl-substituted hydroquinones, mono-branched alkyl-substituted hydroquinones, di-linear alkyl-substituted hydroquinones, and di-branched alkyl-substituted hydroquinones. Further, it is known to use alkylhydroquinones as a color turbidity preventing agent.

In recent years, an increasing requirement level to an improvement in background and gradation control is accompanied with research which is promoted seeking for a higher effect. Above all, it is known to use hydroquinones having a relatively low molecular weight. The use of these hydroquinones having a relatively low molecular weight in an intermediate layer interposed between the silver halide emulsion layers accelerates the improvement in the background in one silver halide emulsion layer but causes problems such that the photographic performance is deteriorated during storage after development processing, and that the hydroquinones are eluted in a color developing solution in the development processing of a light-sensitive material to stain a processing solution during continuous processing and deteriorate a performance of the processing solution.

SUMMARY OF THE INVENTION

Accordingly, the object of the present invention is to provide a silver halide color photographic material which has an excellent background and gradation and which has less fluctuation in a photographic performance during storage provides less deterioration in processing solution performance even with a continuous processing.

The above object of the present invention has been achieved by a silver halide color photographic material comprising a support provided thereon at least one light sensitive silver halide emulsion layer and at least one light insensitive layer, wherein the light insensitive layer contains at least one of the compounds represented by Formula (I) and at least one of the compounds represented by Formula (II); and the total amount of the compounds represented by Formula (II) in the above light insensitive layer is 15 to 100 mole % of the total amount of the compounds represented by Formula (I) in the light insensitive layer:

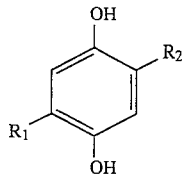

(I)

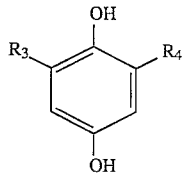

(II)

wherein $R_1$, $R_2$, $R_3$, and $R_4$ each represent an alkyl group, provided that a total of carbon numbers of $R_1$ and $R_2$ and a total of carbon numbers of $R_3$ and $R_4$ each are 16 or more and 60 or less and that a hydroquinone structure is not involved in $R_1$, $R_2$, $R_3$, and $R_4$.

DETAILED DESCRIPTION OF THE INVENTION

Formulas (I) and (II) will be explained in further detail.

$R_1$, $R_2$, $R_3$, and $R_4$ each represent a linear, branched or cyclic, primary, secondary or tertiary, and substituted or unsubstituted alkyl group, provided that a total of the carbon numbers of $R_1$ and $R_2$ and a total of the carbon numbers of $R_3$ and $R_4$ each are 16 or more and 60 or less. This total of the respective carbon numbers is a number including a carbon number of the substituent thereof in the case where $R_1$, $R_2$, $R_3$, and $R_4$ are the substituted alkyl groups, preferably a number which does not include the carbon number of the substituents. The above totals each are preferably 20 or more and 40 or less, more preferably 24 or more and 36 or less. The carbon numbers of $R_1$, $R_2$, $R_3$, and $R_4$ each are preferably 4 or more and 36 or less, more preferably 8 or more and 32 or less, most preferably 10 or more and 26 or less.

There can be enumerated as an unsubstituted alkyl group, for example, a methyl group, an ethyl group, a t-butyl group, an n-butyl group, a t-hexyl group, a t-octyl group, a t-decyl group, a sec-dodecyl group, a sec-tetradecyl group, a sec-hedxadecyl group, a sec-octadecyl group, a 2,6,10-trimethyl-2-dodecyl group, a 7-methyl-7-pentadecyl group, a 1-methylcyclohexyl group, a 1,3,3-tributyl group, and a 3,5,5-trimethylhexyl group.

There can be enumerated as a substituent for substituting the alkyl group in case of a substituted alkyl group, for example, a halogen atom (for example, a fluorine atom, a bromine atom and a chlorine atom), a cyano group, a nitro group, a hydroxyl group, a carboxyl group, a sulfo group, an alkoxy group (for example, methoxy and butoxy), an aryloxy group (for example, phenoxy), an alkylthio group (for example, methylthio and butylthio), an arylthio group (for example, phenyl-thio), a carbonamide group (for example, acetamide and benzamide), a sulfonamide group (for example, methanesulfonamide and benzenesulfoamide), an alkoxycarbonyl group (for example, hexyloxycarbony), an alkoxycarbonyloxy group (for example, hexyloxycarbonyloxy), an acyl group (for example, acetyl), and a sulfonyl group (for example, benzenesulfonyl). These substituents may further be substituted with the same groups or an alkyl group. A halogen atom, a hydroxyl group or an alkoxycarbonyl group is preferred as a substituent for substituting the alkyl group in case of the substituted alkyl group.

An unsubstituted alkyl group is particularly preferred as $R_1$, $R_2$, $R_3$, and $R_4$. Preferred is the case in which $R_1$ and $R_2$ are the same alkyl group, and $R_3$ and $R_4$ are the same alkyl group. Further preferred is the case in which all of them are the secondary or tertiary alkyl groups, and particularly preferred is the case in which all of them are the secondary alkyl groups.

In the case where $R_1$, $R_2$, $R_3$, and $R_4$ are the secondary alkyl groups or tertiary alkyl groups, those groups may be a mixture of branched isomers as described in JP-B-51-12250 (the term "JP-B" as used herein means an examined Japanese patent publication) (corresponding to U.S. Pat. No. 3,700,453) and JP-B61-13748 (corresponding to British Patent 2,005,040).

The concrete examples of the hydroquinone derivatives represented by Formulas (I) and (II) will be shown below but the present invention will not be limited thereto.

(I-1)

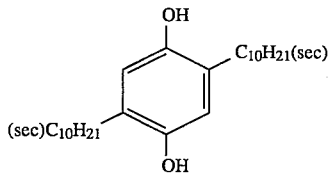

(a mixture of branched isomers)

(I-2)

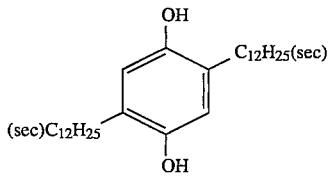

(a mixture of branched isomers)

(I-3)

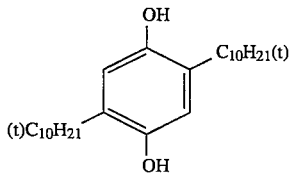

(a mixture of branched isomers)

(I-4)

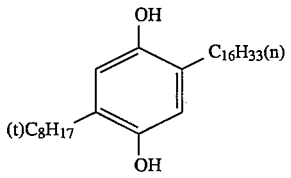

(I-5)

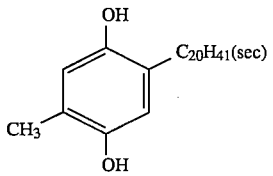

(a mixture of branched isomers)

(I-6)

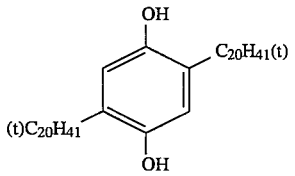

(a mixture of branched isomers)

-continued
(I-7)
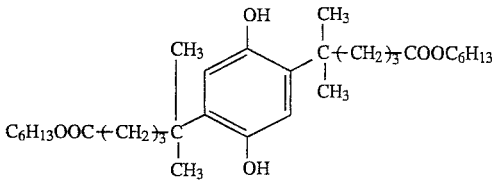
(I-8)
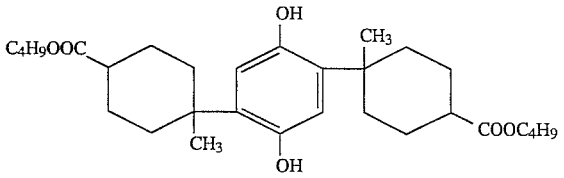
(I-9)
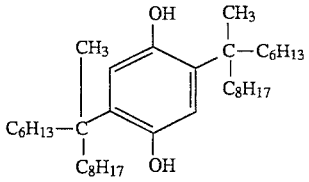
(I-10)
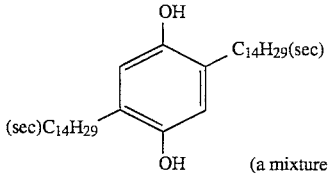
(a mixture of branched isomers)
(I-11)
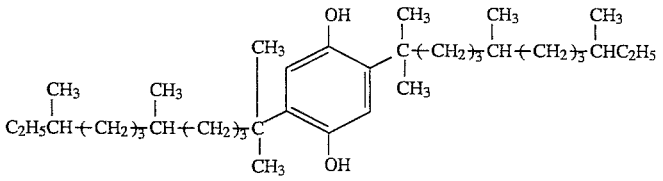
(I-12)
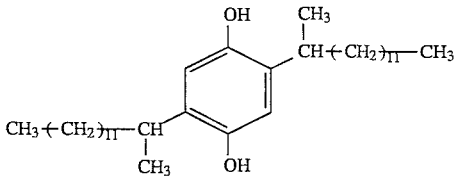
(I-13)
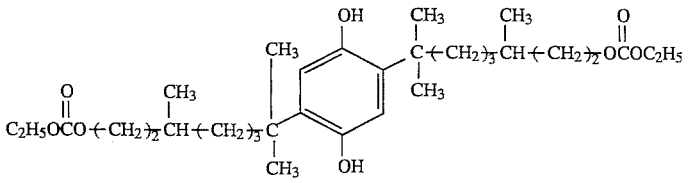
(I-14)
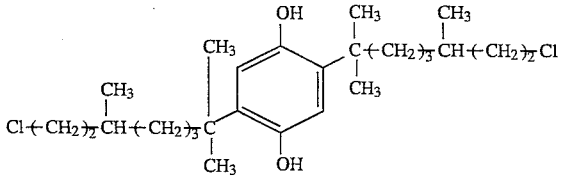

-continued
(I-15)
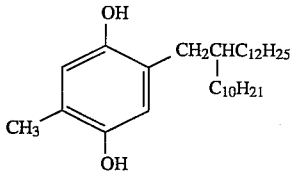
(II-1)
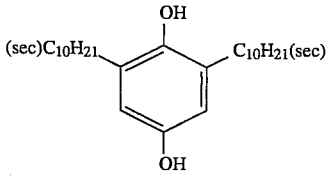
(a mixture of branched isomers)
(II-2)
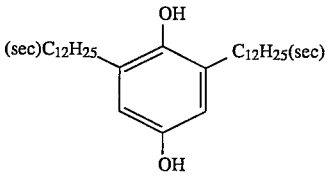
(a mixture of branched isomers)
(II-3)
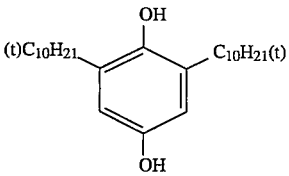
(a mixture of branched isomers)
(II-4)
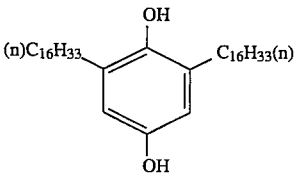
(II-5)
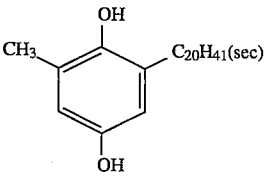
(a mixture of branched isomers)
(II-6)
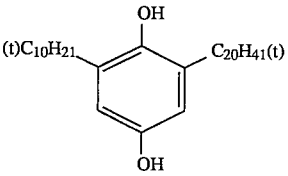
(a mixture of branched isomers)
(II-7)
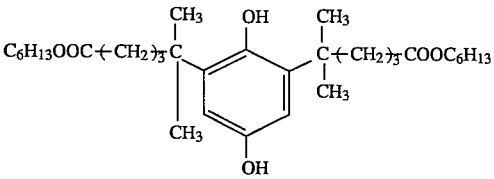

-continued (II-8)

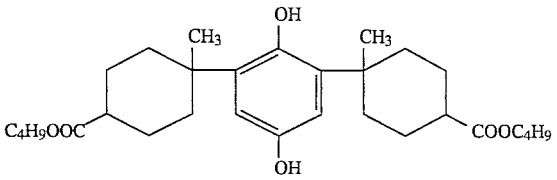

(II-9)

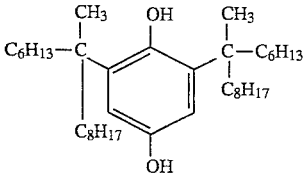

(II-10)

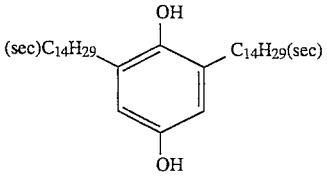

(a mixture of branched isomers)

(II-11)

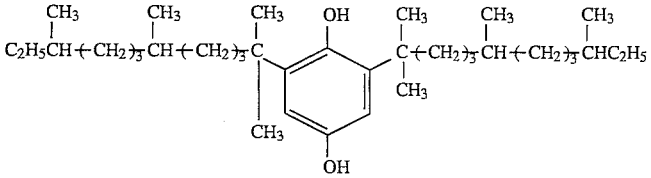

(II-12)

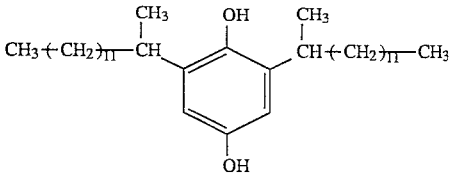

(II-13)

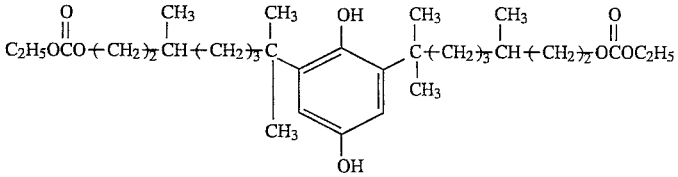

(II-14)

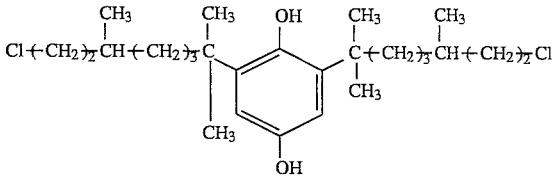

(II-15)

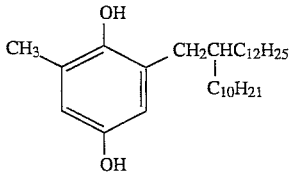

The compounds of Formula (I) according to the present invention can be synthesized with reference to the processes described in JP-B-51-12250 and JP-B-61-13748, and JP-A-57-22237 (the term "JP-A" as used herein means an unexamined published Japanese patent application), JP-A-58-21249, JP-A-58-156932, and JP-A-59-5247. The compounds of Formula (II) according to the present invention can be synthesized with reference to the processes described in Zh. Org. Khim., 15 (9), pp. 1922 (1979), and U.S. Pat. Nos. 2,728,659 and 3,487,117, and they are sometimes obtained as a by-product in the course of synthesizing the compounds of Formula (I).

The photographic material of the present invention may have at least one light sensitive silver halide emulsion layer and at least one light insensitive layer on a support, into which the compound of the present invention represented by Formula (I) and the compound represented by Formula (II) is incorporated by a publicly known process, and the other layers and a layer constitution may have any embodiments. It has preferably the respective light-sensitive silver halide emulsion layers of a yellow color development, a magenta color development and a cyan color development and a light insensitive layer. The respective light-sensitive silver halide emulsion layers of a yellow color development, a magenta color development and a cyan color development are preferably blue-sensitive, green-sensitive and red-sensitive, respectively. The light-sensitive silver halide emulsion layers in the photographic material of the present invention can be provided in this order and constituted but the order may be different from this. Further, an infrared-sensitive silver halide emulsion layer can be used in place of one of the above light-sensitive emulsion layers. There can be enumerated as the light insensitive layer containing the compound of the present invention represented by Formula (I) and the compound of the present invention represented by Formula (II), a protective layer, an intermediate layer interposed between the silver halide emulsion layers, an anti-halation layer, and a UV absorbing layer. It is preferably a light insensitive layer adjacent to the light sensitive silver halide emulsion layer. It is particularly preferably an intermediate layer adjacent to a magenta color-developing light-sensitive silver halide emulsion layer.

The content of the compounds of the present invention represented by Formula (I) falls within the range of $1\times10^{-8}$ mole/m$^2$ to $1\times10^{-2}$ mole/m$^2$, preferably $1\times10^{-7}$ mole/m$^2$ to $1\times10^{-3}$ mole/m$^2$, and most preferably $1\times10^{-6}$ mole/m$^2$ to $1\times10^{-4}$ mole/m$^2$ in the light insensitive layer containing the compound represented by Formula (I) and the compound represented by Formula (II).

The content of the compounds of the present invention represented by Formula (II) falls within the range of $1\times10^{-9}$ mole/m$^2$ to $1\times10^{-2}$ mole/m$^2$, preferably $1\times10^{-8}$ mole/m$^2$ to $1\times 10^{-3}$ mole/m$^2$ and most preferably $1\times10^{-7}$ mole/m$^2$ to $1\times10^{-4}$ mole/m$^2$ in the light insensitive layer containing the compound represented by Formula (I) and the compound represented by Formula (II).

Further, the amount of the compounds represented by Formula (II) in the above light insensitive layer is 15 to 100 mole % of the amount of the compounds represented by Formula (I) in the same light insensitive layer, preferably 20 to 80 mole %, and more preferably 25 to 60 mole %.

In the light-sensitive silver halide emulsion layer in the present invention, various color couplers can be used. The publicly known concrete examples thereof are described in the patents abstracted in above RD No. 17643, VII-C to G and No. 307105, VII-C to G, and JP-A-62-215272, JP-A-3-33847, and JP-A-2-33144.

There can be used in combination as a yellow coupler as long as the effects of the present invention are not damaged, the compounds described in, for example, U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, 4,511,649, and 5,118,599 and European Patents 249,473A and 0,447,969, JP-A-63-23145, JP-A-63-123047, JP-A-1-250944, and JP-A-1-213648. There can be enumerated as the particularly preferred yellow coupler, the yellow couplers represented by Formula (Y) described at page 18, left upper column to page 22, left lower column of JP-A-2-139544, the acylacetamide series yellow couplers characterized by an acyl group, described in JP-A-3-179042, and European Patent Publication 0,447,969, and the yellow couplers of Formula (Cp-2), described in JP-A-5-27389 and European Patent Publication 0,446,863A2.

The 5-pyrazolone series and pyrazoloazole series compounds are preferred as a magenta coupler, and more preferred are those described in U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and International Patent Publication WO88/04795.

In the present invention, the effects of the present invention are large when a coupler contained in a lightsensitive emulsion layer adjacent to a light insensitive layer containing the compounds of represented by Formulas (I) and (II) is a coupler represented by Formula (M):

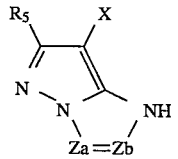

wherein $Z_a$ and $Z_b$ each represent =C($R_6$)— or =N—; $R_5$ and $R_6$ each represent a substituent; and X represents a hydrogen atom or a group capable of splitting off upon a coupling reaction with a an oxidation product of a color developing agent.

Of the couplers represented by Formula (M), preferred is the coupler represented by Formula (M-I) in which $R_5$ in Formula (M) is

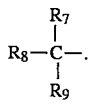

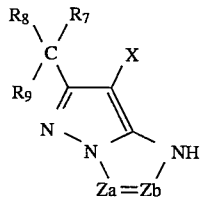

(M-I)

wherein $Z_a$, $Z_b$, X and $R_6$ each are the same as those in Formula (M); and $R_7$, $R_a$ and $R_9$ each represent a substituent. Further, of the couplers represented by Formula (M-I), the coupler represented by Formula (M-I-a) or Formula (M-I-b) is preferred:

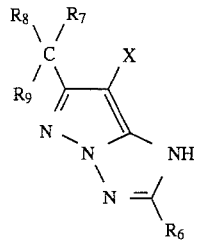

(M-I-a)

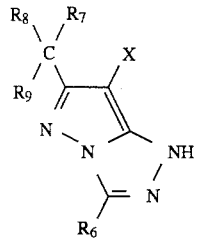

(M-I-b)

wherein X and $R_6$ each has the same definition as those in Formula (M); and $R_7$, $R_8$ and $R_9$ each has the same definition as those in Formula (M-I).

Formulas (M), (M-I), (M-I-a) and (M-I-b) will be explained.

$Z_a$ and $Z_b$ each represent $=C(R_6)-$ or $=N-$. In the case where both of $Z_a$ and $Z_b$ are $=C(R_6)-$, $R_6$'s may be the same or different, or may be combined with each other to form a benzene ring.

There can be enumerated as the substituents in $R_5$, $R_6$, $R_7$, $R_8$ and $R_9$, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imide group, a heterocyclic thio group, a sulfinyl group, a phosphonyl group, an aryloxycarbonyl group, an acyl group, or an azolyl group. These substituents may further have the groups known to be present in a photographic coupler, for example, the substituents described above.

To be more detailed, the substituents in $R_5$, $R_6$, $R_7$, $R_8$ and $R_9$ include a halogen atom (for example, a chlorine atom and a bormine atom), an alkyl group (for example, a linear or branched alkyl group having a carbon number of 1 to 32, an aralkyl group, an alkenyl group, an alkynyl group, a cycloalkyl group, and a cycloalkenyl group, to be detailed, for example, methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy] dodecanamide}-phenyl}propyl, 2-ethoxytridecyl, trifluoromethyl, cyclpentyl, and 3-(2,4-di-t-amylphenoxy)propyl), an aryl group (preferably having a carbon number of 6 to 40; for example, phenyl, 4-t-butylphenyl, 2,4-di-t-amylphenyl, 2,4,6-trimethylphenyl, 3-tridecaneamide-2,4,6-trimethylphenyl, and 4-tetradecaneamidephenyl), a heterocyclic group (preferably having a carbon number of 2 to 40; for example, 2-furyl, 2-thienyl, 2-pyrimidinyl, and 2-benzothiazolyl), a cyano group, a hydroxy group, a nitro group, a carboxy group, a sulfo group, an amino group, an alkoxy group (preferably having a carbon number of 1 to 40; for example, methoxy, ethoxy, 2-methoxyethoxy, 2-dodecylethoxy, and 2-methanesulfonylethoxy), an aryloxy group (preferably having a carbon number of 6 to 40; for example, phenoxy, 2-methylphenoxy, 4-t-butylphenoxy, 3-nitrophenoxy, 3-t-butyloxycarbamoylphenoxy, and 3-methoxycarbamoyl), an acylamino group (preferably having a carbon number of 2 to 40; for example, acetamide, benzamide, tetradecanamide, 2-(2,4-di-t-amylphenoxy)butanamide, 4-(3-t-butyl-4-hydroxyphenoxy)butanamide, and 2-{4-(4-hydroxyphenylsulfonyl)phenoxy}decanamide), an alkylamino group (preferably having a carbon number of 1 to 40; for example, methylamino, butylamino, dodecylamino, diethylamino, and methylbutylamino), an anilino group (preferably having a carbon number of 6 to 40; for example, phenylamino, 2-chloroanilino, 2-chloro-5-tetradecanaminoanilino, 2-chloro-5-dodecyloxycarbonylanilino, N-acetylanilino, and 2-chloro-5-{2-(3-t-butyl-4-hydroxyohenoxy)dodecanamide}anilino), a ureido group (preferably having a carbon number of 1 to 40; for example, phenylureido, methylureido, and N,N-dibutylureido), a sulfamoylamino group (preferably having a carbon number of 0 to 40; for example, N,N-dipropylsulfamoylamino and N-methyl-N-decylsulfamoylamino), an alkylthio group (preferably having a carbon number of 1 to 40; for example, methylthio, octylthio, tetradecylthio, 2-phenoxyethylthio, 3-phenoxypropylthio, and 3-(4-t-butylphenoxy)propylthio), an arylthio group (preferably having a carbon number of 6 to 40; for example, phenylthio, 2-butoxy-5-t-octylphenylthio, 3-pentadecylphenylthio, 2-carboxyphenylthio, and 4-tetradecanamidephenylthio), an alkoxycarbonylamino group (preferably having a carbon number of 2 to 40; for example, methoxycarbonylamino and tertadecyloxycarbonylamino), a sulfonamide group (preferably having a carbon number of 1 to 40; for example, methanesulfoamide, hexadecanesulfonamide, benzenesulfonamide, p-toluenesulfonamide, octadecanesulfonamide, and 2-methoxy-5-t-butylbenznesulfonamide), a carbamoyl group (preferably having a carbon number of 1 to 40; for example, N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)propyl}carbamoyl), a sulfamoyl group (preferably having a carbon number of 0 to 40; for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (preferably having a carbon number of 1 to 40; for example, methanesulfonyl, octanesulfonyl, benzenesulfonyl, and toluenesulfonyl), an alkoxycarbonyl group (preferably having a carbon number of 2 to 40; for example, methoxycarbonyl, butylcarbonyl, dodecyloxycarbonyl, and octadecyloxycarbonyl), a heterocyclic oxy group (preferably having a carbon number of 2 to 40; for example, 1-phenyltetrazole-5-oxy and 2-tetrahydropyranyloxy), an azo group (preferably having a carbon number of 2 to 40; for example, phenylazo, 4-methoxyphenylazo, 4-pivalylaminophenylazo, and 2-hydroxy-4-propanoylphenylazo), an acyloxy group (preferably having a carbon number of 2 to 40; for example, acetoxy), a carbamoyloxy group (preferably having a carbon number of 1 to 40; for example, N-methylcarbamoyloxy and N-phenylcarbamoyloxy), a silyloxy group (preferably having a carbon number of 3 to 40; for example, trimethylsilyloxy and dibutylmethylsilyloxy), an aryloxycarbonylamino group (preferably having a carbon number of 7 to 40; for example phenoxycarbonylamino), an imide group (preferably having a carbon number of 4 to 40; for example, N-succinimide, N-phthalimide, and 3-octadecenylsuccinimide), a heterocyclic thio group (preferably having a carbon number of 2 to 40; for example, 2-benzothiazolylthio, 2,4-di-phenoxy-1,3, 5-triazole-6-thio, and 2-pyridylthio), a sulfinyl group (preferably having a carbon number of 1 to 40; for example, dodecanesulfinyl, 3-pentadecylphenylsulfinyl, and 3-phenoxypropylsulfinyl), a phosphonyl group (preferably having a carbon number of 2 to 40; for example, phenoxyphosphonyl, octyloxyphosphonyl, and phenylphosphonyl), an aryloxycarbonyl group (preferably having a carbon number of 7 to 40; for example, phenoxycarbonyl), an acyl group (preferably having a carbon number of 1 to 40; for example, acetyl, 3-phenylpropanoyl, benzoyl, and 4-decyloxybenzoyl), and an azolyl group (preferably having a carbon number of 2 to 40; for example, imidazolyl, pyrazolyl, 3-chloropyrazole-1-yl, and triazolyl).

Of those described above, preferred as the substituents in $R_5$, $R_6$, $R_7$, $R_8$, and $R_9$ are an alkyl group, an aryl group, an anilino group, an acylamino group, a sulfonamide group, an alkoxy group, an alkylthio group, and an arylthio group.

More preferred as $R_5$ are an alkyl group, an alkoxy group, and an aryloxy group, more preferably an alkyl group, and particularly preferably

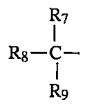

as described above.

More preferred as $R_6$ are an alkyl group, an aryl group, an anilino group, and an alkoxy group, more preferably an alkyl group or an aryl group, and an aryl group is particularly preferred. Of the alkyl groups, preferred are those substituted with an acylamino group, a sulfonamide group, a sulfonyl group, or a carbamoyl group, and more preferred is an alkyl group having branched carbon atoms bonded directly to a mother nucleus. Of the aryl groups, preferred are those in which the para position thereof is substituted with an acylamino group or a sulfonamide group.

More preferred as $R_7$, $R_8$ and $R_9$ are an alkyl group, an aryl group, an anilino group, and an alkoxy group. An alkyl group is most preferred and methyl or ethyl is particularly preferred.

X represents a hydrogen atom or a group (hereinafter referred to as a splitting group) capable of splitting off upon a reaction with an oxidation product of an aromatic primary amine series color developing agent. To describe the splitting group in detail, it includes a halogen atom, an alkoxy group, an aryloxy group, a hetrocyclicoxy group, an alkylthio group, an arylthio group, a heterocyclic thio group, an acylamino group, and a 5- or 6-membered nitrogen-containing heterocyclic group bonded via a nitrogen atom. These splitting groups may further be substituted with the groups known to be present in a splitting group of a photographic coupler, for example, the groups allowed as the substituents for $R_5$.

To be more detailed, the splitting group includes a halogen atom (for example, a fluorine atom, a chlorine atom and a bromine atom), an alkoxy group (preferably having a carbon number of 1 to 40; for example, ethoxy, dodecyloxy, methoxyethylcarbamoylmethoxy, carboxypropyloxy, methylsulfonylethoxy, and ethoxycarbonylmethoxy), an aryloxy group (preferably having a carbon number of 6 to 40; for example, 4-methylphenoxy, 4-chlorophenoxy, 4-methoxyphenoxy, 4-carboxyphenoxy, 3-ethoxycarboxyphenoxy, 4-methoxycarbonylphenoxy, 3-acetylaminophenoxy, and 2-carboxyphenoxy), a heterocyclic oxy group (preferably having a carbon number of 2 to 40; for example, tetrazolyoxy), an alkylthio group (preferably having a carbon number of 1 to 40; for example, dodecylthio and 1-carboxydodecylthio), an arylthio group (preferably having a carbon number of 6 to 40; for example, phenylthio, 2-butoxy-5-t-octylphenylthio, and 2-benzyloxycarbonylaminophenylthio), a heterocyclic thio group (preferably having a carbon number of 2 to 40; for example, tetrazolylthio), an acylamino group (preferably having a carbon number of 2 to 40; for example, dichloroacetylamino and heptafluorobutylylamino), and a 5-membered or 6-membered nitrogen-containing heterocyclic group bonded via a nitrogen atom (preferably having a carbon number of 2 to 40; for example, 1-imidazolyl, 1-pyrazolyl, 1,2,4-triazol-1-yl, tetrazolyl, 3,5-dimethyl-1-pyrazolyl, 4-cyano-1-pyrazolyl, 4-methoxycarbonyl-1-pyrazolyl, 4-acetylamino-1-pyrazolyl, and 1,2-dihydro-2-oxo-1-pyridyl). In addition thereto, X sometimes takes as a splitting group bonded via a carbon atom, the form of a bis type coupler which can be obtained by condensing a tetraequivalent coupler with aldehydes and ketones. X may contain the photographically useful groups such as a development inhibitor and a development accelerator. X is preferably a splitting group, more preferably a halogen atom, an alkoxy group, an aryloxy group, or an arylthio group, and particularly preferably a chlorine atom.

The coupler examples represented by Formula (M) will be shown below but are not limited thereto.

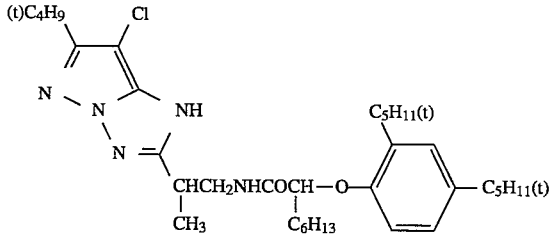

(M-1)

-continued
(M-2)
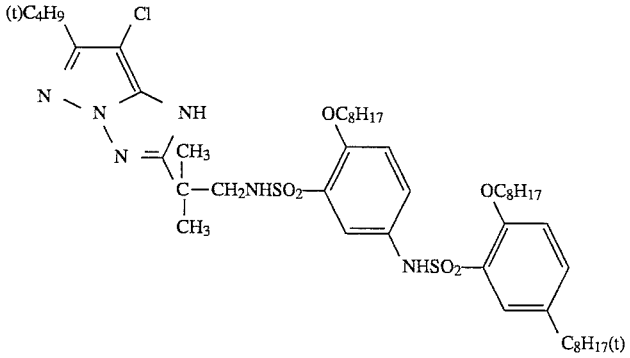
(M-3)
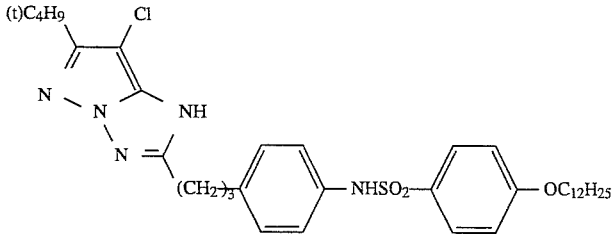
(M-4)
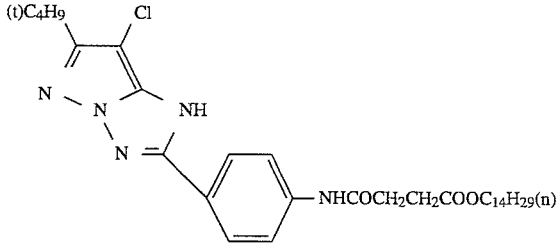
(M-5)
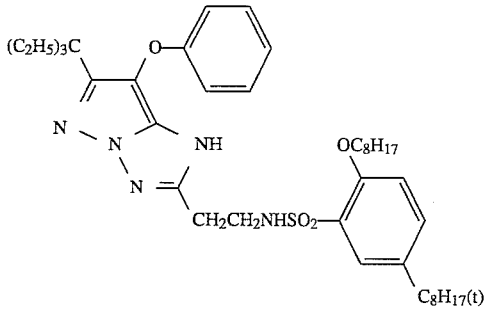
(M-6)
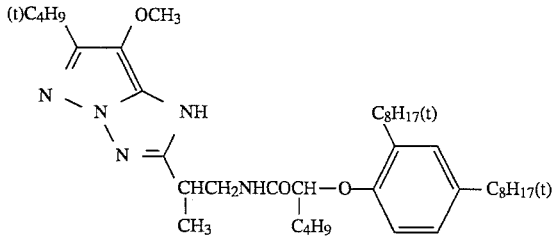
(M-7)
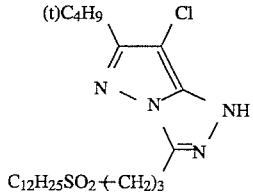

-continued
(M-8)
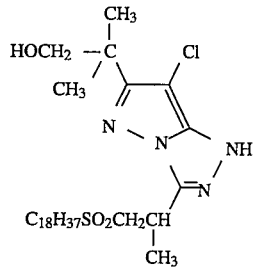
(M-9)
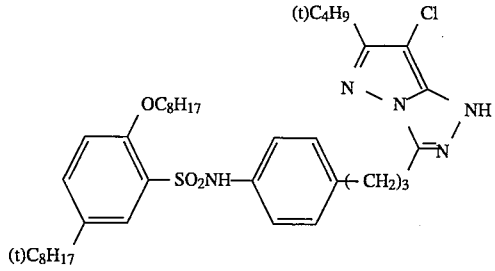
(M-10)
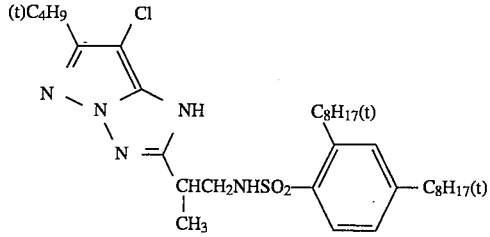
(M-11)
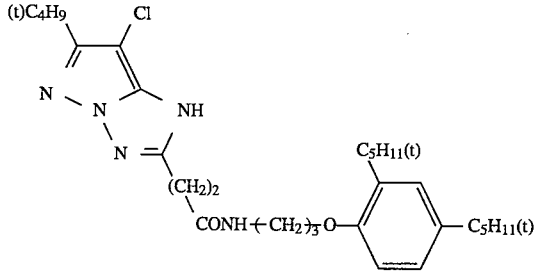
(M-12)
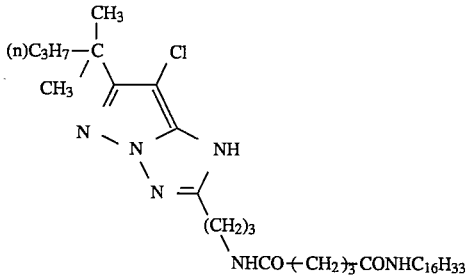
(M-13)
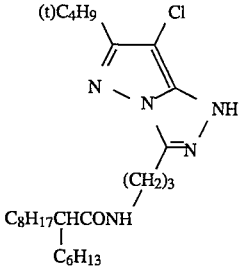

-continued
(M-14)
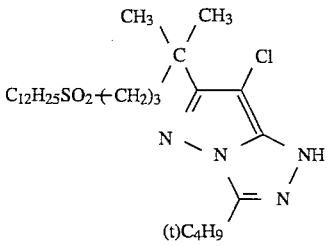
(M-15)
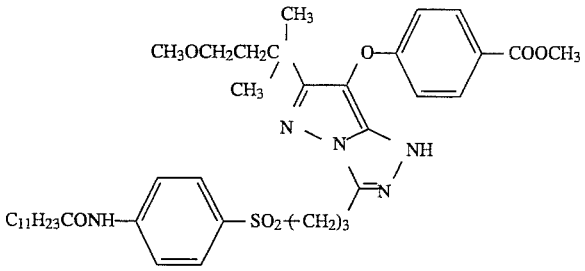
(M-16)
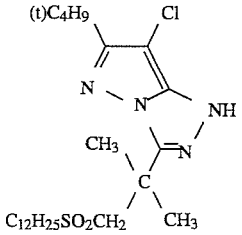
(M-17)
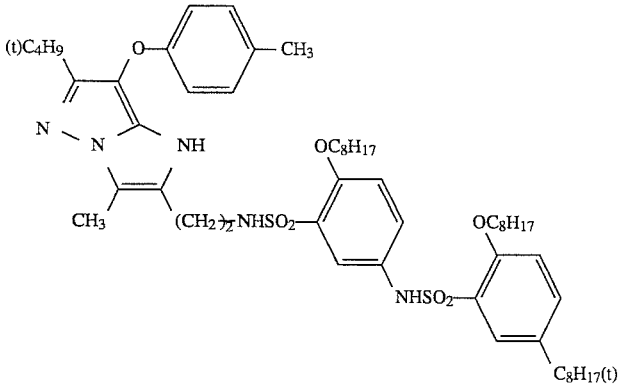
(M-18)
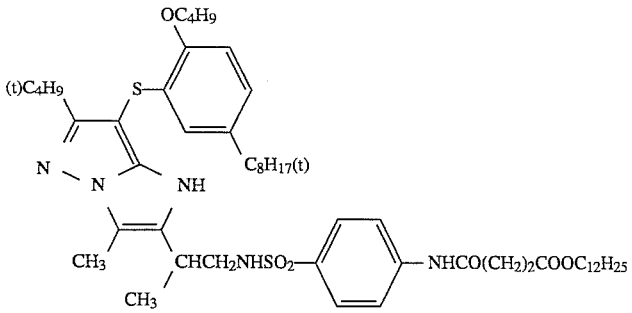

-continued (M-19)

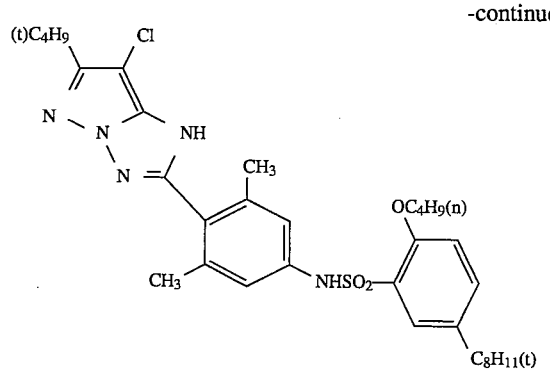

(M-20)

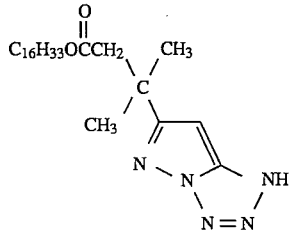

(M-21)

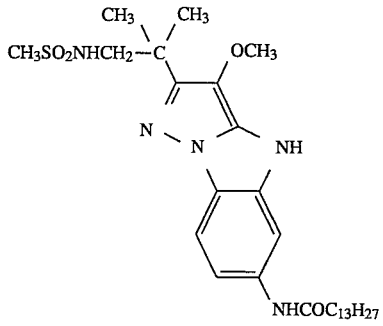

(M-22)

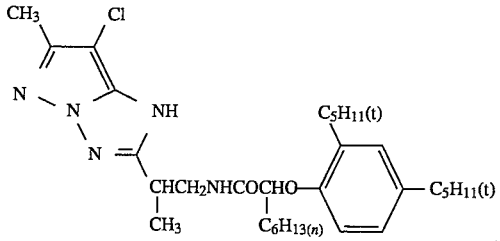

The couplers represented by Formula (M) are described in U.S. Pat. Nos. 3,061,432, 3,725,067, 4,500,630, 4,540,654, and 4,705,863, JP-B-47-27411, and JP-A-60-33552, JP-A-61-65245, JP-A-62-209457, JP-A-62-249155, and JP-A-60-33552.

The phenol series and naphthol series couplers can be enumerated as a cyan coupler. Preferred are the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication (OLS) 3,329,729, European Patents 0,121,365A and 0,249,453A, U.S. Pat. Nos. 3,446,622, 4,333,999, 4,775,616, 4,451,559, 4,427,767, 4,690,889, 4,254,212, and 4,296,199, and JP-A-61-42658. Further, there can be used as well the pyrazoloazole series couplers described in JP-A-64-553, JP-A-64-554, JP-A-64-555, and JP-A-64-556, the pyrrolotriazole series couplers described in European Patent Publications 0,488,248 and 0,491,197, the pyrroloimidazole series couplers described in European Patent Publication 0,456,226A, the pyrazolopyrimidine series couplers described in JP-A-64-46753, the imidazole series couplers described in U.S. Pat. No. 4,818,672 and JP-A-2-33144, the cyclic active methylene type cyan couplers described in JP-A-64-32260, and the couplers described in JP-A-1-183658, JP-A-2-262655, JP-A-2-85851, and JP-A-3-48243.

The typical examples of a polymerized dye-forming coupler are described in U.S. Pat. Nos. 3,451,820, 4,080,211, 4,367,282, 4,409,320, and 4,576,910, British Patent 2,102,137, and European Patent 341,188A. Preferred as a coupler capable of forming a dye having an appropriate dispersing property are the compounds described in U.S. Pat. No. 4,366,237, British Patent 2,125,570, European Patent 96,570, and German Patent (OLS) 3,234,533. Preferred as a colored coupler used for correcting an unnecessary absorption of a developed dye are the compounds described in Research Disclosure No. 17643, Item VII-G and No. 307105, Item VII-G, U.S. Pat. No. 4,163,670, JP-B-57-39413, U.S. Pat. Nos. 4,004,929 and 4,138,258, and British Patent 1,146,368. Also, preferably used are the couplers which correct the unnecessary absorption of a developed dye with a fluorescent dye released in coupling, described in U.S. Pat. No. 4,774,181, and the couplers having as a releasing group a dye precursor group capable of reacting with a developing agent to form a dye, described in U.S. Pat. No. 4,777,120.

In the present invention, there can also be preferably used the compounds releasing a photographically useful residues upon coupling. Preferred as a DIR coupler releasing a development inhibitor are the compounds described in the patents described in above RD No. 17643, Item VII-F and No. 307105, Item VII-F, JP-A-57-151944, JP-A-57-154234, JP-A-60-184248, JP-A-63-37346, and JP-A-63-37350, and U.S. Pat. Nos. 4,248,962 and 4,782,012.

The bleaching agent-releasing couplers described in RD No. 11449 and 24241, and JP-A-61-201247 are effective for shortening a time in a processing process having a bleaching ability and are effective particularly when they are added to a light-sensitive material in which the above tabular silver halide grains are used.

Preferred as a coupler releasing imagewise a nucleus-forming agent or a development accelerator in developing are the compounds described in British Patents 2,097,140 and 2,131,188, and JP-A-59-157638 and JP-A-59-170840. Preferred as well are the compounds releasing a fogging agent, a development accelerator and a silver halide solvent upon an oxidation reduction reaction with an oxidation product of a developing agent, described in JP-A-60-107029, JP-A-60-252340, JP-A-1-44940 and JP-A-1-45687.

In addition to the above, there can be enumerated as the compounds capable of being used for the light-sensitive material of the present invention, the competitive couplers described in U.S. Pat. No. 4,130,427; the polyequivalent couplers described in U.S. Pat. Nos. 4,283,472, 4,338,393 and 4,310,618; the DIR redox compound-releasing couplers, DIR couplerreleasing couplers, DIR coupler-releasing redox compounds, or DIR redox-releasing redox compounds described in JP-A-60-185950 and JP-A-62-24252; the couplers releasing a dye whose color is recovered after splitting off, described in European Patents 173,302A and 313,308A; the ligand-releasing couplers described in U.S. Pat. No. 4,555,477; the couplers releasing a leuco dye, described in JP-A-63-75747; and the couplers releasing a fluorescent dye, described in U.S. Pat. No. 4,774,181.

A standard use amount of these color couplers in the present invention resides in the range of 0.001 to 1 mole per mole of a light-sensitive silver halide contained in the same light-sensitive silver halide emulsion layer, preferably 0.01 to 0.5 mole for a yellow coupler, 0.003 to 0.3 mole for a magenta coupler, and 0.002 to 0.3 mole for a cyan coupler.

Various antifading agents can be used for the light-sensitive material of the present invention. That is, there can be enumerated as the representative examples of an organic antifading agent for cyan, magenta and/or yellow images, hydroquinones, 6-hydroxychromans, 5-hydroxycoumarans, spirochromans, p-alkoxyphenols, hindered phenols represented by bisphenols, gallic acid derivatives, methylenedioxybenzenes, aminophenols, hindered amines, and ether or ester derivatives thereof obtained by silylating or alkylating the phenolic hydroxy groups of the respective groups. Further, there can be used as well the metal complex compounds represented by (bis-salicylaldoximate) nickel complex and (bis-N,N-dialkyldithiocarbamate) nickel complex.

The concrete examples of the organic antifading agent are described in the following patents. Hydroquinones are described in U.S. Pat. Nos. 2,360,290, 2,418,613, 2,700,453, 2,701,197, 2,728,659, 2,732,300, 2,735,765, 3,982,944, and 4,430,425, British Patent 1,363,921, U.S. Pat. Nos. 2,710,801 and 2,816,028; 6-hydroxychromans, 5-hydroxychromans and spirochromans are described in U.S. Pat. Nos. 3,432,300, 3,573,050, 3,574,627, 3,698,909, and 3,764,337, and JP-A-52-152225; spiroindanes are described in U.S. Pat. No. 4,360,589; p-alkoxyphenols are described in U.S. Pat. No. 2,735,765, British Patent 2,066,975, JP-A-59-10539, and JP-B-57-19765; hindered phenols are described in U.S. Pat. No. 3,700,455, JP-A-52-72224, U.S. Pat. No. 4,228,235, and JP-B-52-6623; gallic acid derivatives, methylenedioxybenzenes, and aminophenols are described in U.S. Pat. No. 3,457,079 and 4,332,886, and JP-B-56-21144; hindered amines are described in U.S. Pat. Nos. 3,336,135 and 4,268,593, British Patents 1,326,889, 1,354,313, and 1,410,846, JP-B-51-1420, and JP-A-58-114036, JP-A-59-53846, and JP-A-59-78344; and metal complex compounds are described in U.S. Pat. Nos. 4,050,938 and 4,241,155, and British Patent 2,027,731 (A). These compounds, which are emulsified together with the respective corresponding couplers in the ratios of 5 to 100% by weight based on the amounts of the couplers, are added to the light-sensitive layer to achieve the objects of the present invention.

For the purpose of preventing the deterioration of a cyan dye image by heat and particularly by light, it is more effective to incorporate a UV absorber into a cyan color-developing layer and the layers adjacent thereto.

There can be used as the UV absorber, the benzotriazole compounds substituted with an aryl group (for example, the compounds described in U.S. Pat. No. 3,533,794), the 4-thiazolidone compounds (for example, the compounds described in U.S. Pat. Nos. 3,314,794 and 3,352,681), the benzophenone compounds (for example, the compounds described in JP-A-46-2784), the cinnamic acid ester compounds (for example, the compounds described in U.S. Pat. Nos. 3,705,805 and 3,707,395), the butadiene compounds (for example, the compounds described in U.S. Pat. No. 4,045,229), and benzoxazole compounds (for example, the compounds described in U.S. Pat. Nos. 3,406,070, 3,677,672, and 4,271,307). There may be used a UV absorptive coupler (for example, an α-naphthol series cyan dye-forming coupler) and a UV absorptive polymer. These UV absorbers may be mordanted to a specific layer. Of them, the above benzotriazole compounds substituted with an aryl group are preferred.

The compound shown below is particularly preferably used together with the couplers described above. In particular, it is used preferably in combination with the above coupler represented by Formula (M) and a coupler such as a pyrroloazole coupler.

That is, further preferably used simultaneously or singly for preventing side effects of, for example, the generation of stain due to the reaction of a color developing agent or the oxidation product thereof remained in a layer during a storage after processing with a coupler are the compounds (F) which are chemically combined with an aromatic amine series developing agent remained after a color development processing to form a chemically inactive and substantially colorless compound and/or the compounds (G) which are chemically combined with an oxidation product of an aromatic amine series developing agent remained after the color development processing to form a chemically inactive and substantially colorless compound.

The compounds (G) and/or (F) are used in an amount of 2 to 300 mol %, preferably 5 to 200 mol % based on the amount of the couplers used together.

The details of these compound (G) and compound (F) and the combination thereof are described in European Patent Publication 277,589.

The light-sensitive material prepared by applying the present invention may contain a water soluble dye and a dye which becomes water soluble by a photographic processing as a filter dye in a hydrophilic colloid layer or for various purposes of the prevention of irradiation and halation and others. Included in such the dye are an oxonol dye, a hemioxnol dye, a styryl dye, a merocyanine dye, a cyanine dye, and an azo dye. Of them, an oxonol dye, a hemioxonol dye, and a merocyanine dye are useful.

The silver halide emulsions, other materials (the additives and others) and photographic constitutional layers (a layer arrangement and others) each applied in the present invention, and the processing processes and the additives for processing, which are applied for processing this light-sensitive material are described in JP-A-62-215272, JP-A-2-33144, and JP-A-4-359249, and European Patent EP 0,355,660A2, and those described in the following patent publications, particularly European Patent EP 0,355,660A2 are preferably used.

TABLES 1 to 5

| Photographic elements | JP-A-62-215272 | JP-A-2-33144 | EP 0355660A2 |
|---|---|---|---|
| Silver halide emulsion | pp. 10, right upper colmn, line 6 to pp. 12, left lower colmn, line 5, and pp. 12, right lower colmn, line 4 from bottom to pp. 13, left upper colmn, line 17. | pp. 28, right upper colmn, line 16 to pp. 29, right lower colmn line 11, and pp. 30, line | pp. 45, line 53 to pp. 47, line 3, and pp. 47, line 20 to 22. |
| Silver halide solvent | pp. 12, left lower colmn, line 6 to 14, and pp. 13, left upper colmn, line 3 from bottom to pp. 18, left lower colmn, last line. | — | — |
| Chemical sensitizer | pp. 12, left lower colmn, line 3 from bottom to right lower colmn, line 5 from bottom, and pp. 18, right lower colmn, line 1 to pp. 22, right upper colmn, line 9 from bottom. | pp. 29, right lower colmn, line 12 to last line. | pp. 47, line 4 to 9. |
| Spectral sensitizer (spectral sensitizing method) | pp. 22, right upper colmn, line 8 from bottom to pp. 38, last line. | pp. 30, left upper colmn, line 1 to 13. | pp. 47, line 10 to 15. |
| Emulsion stabilizer | pp. 39, left upper colmn, line 1 to pp. 72, right upper colmn, last line. | pp. 30, left upper colmn, line 14, to right upper colmn, line 1. | pp. 47, line 16 to 19. |
| Development accelerator | pp. 72, left lower colmn, line 1 to pp. 91, right upper colmn, line 3. | — | — |
| Color coupler (cyan, magenta and yellow couplers) | pp. 91, right upper colmn, line 4 to pp. 121, left upper colmn, line 6. | pp. 3, right upper colmn, line 14 to pp. 18, left upper colmn, last line, and pp. 30, right upper colmn, line 6, to pp. 35 right lower colmn, line 11. | pp. 4, line 15 to 27, pp. 5, line 30 to pp. 28, last line, and pp. 47, line 23 to pp. 63, line. 50 |
| Color forming accelerator | pp. 121, left upper colmn, line 7 to pp. 125, right upper colmn, line 1. | — | — |
| UV absorber | pp. 125, right upper colmn, line 2 to pp. 127, left lower colmn, last line. | pp. 37, right lower colmn, line 14 to pp. 38, left upper colmn, line 11. | pp. 65, line 22 to 31. |
| Anti-fading agent (an image stabilizer) | pp. 127, right lower colmn, line 1 to pp. 137, left lower colmn, line 8. | pp. 36, right upper colmn, line 12 to pp. 37, left upper colmn, line 19. | pp. 4, line 30 to pp. 5, line 23, pp. 29, line 1 to pp. 45, line 25, pp. 45, line 33 to 40, and pp. 65, line 2 to 21. |
| High boiling and/or low boiling organic solvent | pp. 137, left lower colmn, line 9 to pp. 144, right upper, last line. | pp. 35, right lower colmn, line 14 to pp. 36, left upper, line 4. | pp. 64, line 1 to 51. |
| Method for dispersing photographic additives | pp. 144, left lower colmn, line 1 to pp. 146, right upper colmn, line 7. | pp. 27, right lower colmn, line 10 to pp. 28, left upper, last line, and pp. 35, right lower colmn, line 12 to pp. 36, right upper colmn, line 7. | pp. 63, line 51 to pp. 64, line 56. |
| Hardener | pp. 146, right upper colmn, line 8 to pp. 155, left lower colmn, line 4. | — | — |

TABLES 1 to 5-continued

| Photographic elements | JP-A-62-215272 | JP-A-2-33144 | EP 0355660A2 |
|---|---|---|---|
| Precursor of a developing agent | pp. 155, left lower colmn, line 5 to right lower colmn, line 2. | — | — |
| Development inhibitor-releasing compound | pp. 155, right lower colmn, line 3 to 9. | — | — |
| Support | pp. 155, right lower colmn, line 19 to pp. 156, left upper colmn, line 14. | pp. 38, right upper colmn, line 18 to pp. 39, left upper colmn, line 3. | pp. 66, line 29 to pp. 67 line 13. |
| Light-sensitive layer structure | pp. 156, left upper colmn, line 15 to right lower colmn, line 14. | pp. 28, right upper colmn, line 1 to 15. | pp. 45, line 41 to 52 |
| Dye | pp. 156, right lower colmn, line 15 to pp. 184, right lower colmn, last line. | pp. 38, left upper colmn, line 12 to right upper colmn, line 7. | pp. 66, line 18 to 22. |
| Anti-color mixing agent | pp. 185, left upper colmn, line 1 to pp. 188, right lower colmn, line 3. | pp. 36, right upper colmn, line 8 to line 11. | pp. 64, line 57 to pp. 65 line 1. |
| Gradation controller | pp. 188, right lower colmn, line 4 to 8. | — | — |
| Anti-stain agent | pp. 188, right lower colmn, line 9 to pp. 193, right lower colmn, line 10. | pp. 37, left upper colmn, last line to right lower colmn, line 13. | pp. 65, line 32 to pp. 66, line 17. |
| Surface active agent | pp. 201, left lower colmn, line 1 to pp. 210, right upper colmn, last line | pp. 18, right upper colmn, line 1 to pp. 24, right lower colmn, last line and pp, 27, left lower colmn, line 10 from bottom to right lower colmn, line 9. | — |
| Fluorinated compound (anti-electrification agent, coating aid, lubricant and anti-adhesion agent) | pp. 210, left lower colmn, line 1 to pp. 222, left lower colmn, line 5. | pp. 25, left upper colmn, line 1 to pp. 27, right lower colmn, line 9. | |
| Binder (hydrophilic colloid) | pp. 222, left lower colmn, line 6 to pp. 225, left upper colmn, last line. | pp. 38, right upper colmn, line 8 to 18. | pp. 66, line 23 to 28. |
| Thickener | pp. 225, right upper colmn, line 1 to pp. 227, right upper colmn, line 2. | — | — |
| Anti-electrification agent | pp. 227, right upper colmn, line 3 to pp. 230, left upper colmn, line 1. | — | — |
| Polymer latex | pp. 230, left upper colmn, line 2 to pp. 239, last line | — | — |
| Matting agent | pp. 240, left upper colmn, line 1 to right upper colmn, last line. | — | — |
| Photographic processing method (processing steps and additives) | pp. 3, right upper column, line 7 to pp. 10, right upper colmn, line 5. | pp. 39, left upper colmn, line 4 to pp. 42, left upper colmn. last line. | pp. 67, line 14 to pp. 69, line 28. |

Remarks:
1. The cited parts of JP-A-62-215272 included the amendment dated March 16, 1987 attached to the end of publication.
2. Of the above color couplers, preferably used as the yellow coupler are the so-called short wave type yellow couplers discribed in JP-A-63-231451, JP-A-63-123047, JP-A-63-241547, JP-A-1-173499, JP-A-1-213648, and JP-A-1-250944.

There can be used as silver halide for the present invention, any silver halide such as silver chloride, silver bromide, silver bromochloride, silver chloroiodide, silver bromochloroiodide, and silver bromoiodide. Among them, in case of a color light-sensitive material for photographing and a color reversal light-sensitive material (for example, a color negative film, a reversal film, and a color reversal paper), preferred is silver bromoiodide, silver chloroiodide or silver bromochloroiodide containing silver iodide of 0.1 to 30 mole %. Silver bromoiodide containing silver iodide of 1 to 25 mole % is particularly preferred. In case of a direct positive color light-sensitive material (for example, a color proof using Internal latent image type emulsion), silver chloride, silver bromide or silver bromochloride is preferred, and silver bromide is particularly preferred. In case of a light-sensitive material for paper, silver chloride or silver bromochloride containing substantially no silver iodide is preferred, and particularly preferred is a silver chlorobromide containing silver chloride of 80 mole % or more, more preferably 95 mole % or more, and most preferably 98 mole % or more or pure silver chloride emulsion.

The suitable supports which can be used in the present invention are described in, for example, above Research Disclosures (RD) No. 17643, pp. 28 and No. 18716, pp. 647, a right column to pp. 648, a left column.

There can usually be used as the support used for the present invention, a transparent film such as cellulose nitrate film and polyethylene terephthalate and a reflecting type support each used for a photographic light-sensitive material. The reflective support is preferably used for the purpose of the present invention.

The "reflective support" used in the present invention includes, for example, a polyethylene-coated paper, a polypropylene series synthetic paper, a transparent support having a reflecting layer provided thereon in combination or using a reflective material in combination, for example, a glass plate, a polyester film such as polyethylene terephthalate, cellulose triacetate and cellulose nitrate, a polyamide film, a polycarbonate film, a polyethylene film, and a vinyl chloride resin.

There may be used as a support used for the light-sensitive material according to the present invention for display, a white color polyester series support or a support in which a layer containing a white pigment is provided on a support side having a silver halide emulsion layer. Further, an anti-halation layer is preferably provided on a support side coated thereon with a silver halide emulsion layer or the backside thereof in order to further improve a sharpness. In particular, a transmission density of a support is set preferably in the range of 0.35 to 0.8 so that a display can be admired with either a reflected light or a transmitted light.

The light-sensitive material according to the present invention may be exposed with either a visible ray or an infrared ray. An exposing manner may be either a low illuminance exposure or a high illuminance and short time exposure. Particularly in the latter case, preferred is a laser scanning exposing process in which an exposing time per a picture element is shorter than $10^{-4}$ second.

In exposure, a band stop filter described in U.S. Patent 4,880,726 is preferably used, whereby a light mixture is removed to notably improve a color reproduction.

The light-sensitive material of the present invention is subjected to a color development processing, a desilver processing, a washing processing and/or a stabilizing processing after an imagewise exposure as usual.

The details of a processing process of a light-sensitive material are described in Research Disclosures No. 17643, pp. 28 to 29, No. 17643, pp. 651, a left column to a right column, and No. 307105, pp. 880 to 881, JP-A-2-207250 pp. 26, a right lower column, 1st line to pp. 34, a right upper column, 9th line, JP-A-4-97355 pp. 5, a left lower column, 17th line to pp. 18, a right lower column, 20th line, JP-A-3-33847, JP-A-3-213853, JP-A-3-237456, JP-A-3-293662, JP-A-4-130432, and JP-A-4-359249, in addition to the processes described in the above tables.

There can be used as a color developing agent in a color developing process, those described in European Patent Publication 410450 and JP-A-4-11255 as well in addition to those described in above Research Disclosures and the patents. There can be enumerated as the representative examples thereof, 3-methyl-4 -amino-N, N-diethylaniline, 3-methyl-4 -amino-N-ethyl-N-β-hydroxyethylaniline, 3-methyl-4-amino-N-ethyl-N-β-methanesulfonamidethylaniline, 3-methyl-4-amino-N-ethyl-β-methoxyethylamine, 4-amino-3-methyl-N-methyl-N-(3hydroxypropyl) aniline, 4-amino-3-methyl-N-ethyl-N-(3-hydroxypropyl) aniline, 4-amino-3-methyl-N-ethyl-N-(2-hydroxypropyl) aniline, 4-amino-3-ethyl-N-ethyl-N-(3-hydroxypropyl) aniline, 4-amino-3-methyl-N-propyl-N-(3-hydroxypropyl) aniline, 4-amino-3-propyl-N-methyl-N-(3-hydroxypropyl) aniline, 4-amino-3-methyl-N-methyl-N-(4-hydroxybutyl) aniline, 4-amino-3-methyl-N-ethyl-N-(4-hydroxybutyl) aniline, 4-amino-3-methyl-N-propyl-N-(4-hydroxybutyl) aniline, 4-amino-3-ethyl-N-ethyl-N-(3-hydroxy-2-methylpropyl) aniline, 4-amino-3-methyl-N,N-bis(4-hydroxybutyl) aniline, 4-amino-3-methyl-N,N-bis(5-hydroxypentyl) aniline, 4 -amino-3-methyl-N-(5-hydroxypentyl)-N-(4-hydroxybutyl)aniline, 4-amino-3-methoxy-N-ethyl-N-(4-hydroxybutyl) aniline, 4-amino-3-ethoxy-N,N-bis(5-hydroxypentyl) aniline, 4-amino-3-propyl-N(4-hydroxybutyl) aniline, and the sulfates, chlorinates and p-toluenesulfonates thereof. Of them, particularly preferred are 3-methyl-4-amino-N-ethyl-N-β-hydroxyethylaniline, 4-amino-3-methyl-N-ethyl-N-(3-hydroxypropyl) aniline, 4-amino-3-methyl-N-ethyl-N-(4-hydroxybutyl) aniline, and the sulfates, chlorinates and p-toluenesulfonates thereof. These compounds can be used as well in combination of two or more kinds according to the purposes.

In general, a desilver process is carried out by combining a bleaching process, a bleach-fixing process, and a fixing process. To be concrete, the following ones are enumerated:

Bleaching-fixing.

Bleaching-washing-fixing.

Bleaching-bleach-fixing.

Bleaching-washing-bleach-fixing.

Bleaching-bleach-fixing- fixing.

Bleach-fixing.

Fixing-bleaching-fixing.

A publicly known bleaching agent can be used as a bleaching agent in a bleaching solution or a bleach-fixing solution. It is preferably an organic acid ferric complex salt, and there can be enumerated as organic acid constituting the organic acid ferric complex salt, ferric complex salts of organic acids such as ethylenediaminetetraacetic acid, 1,3-diaminopropanetetraacetic acid, 1,4-butylenediaminetetraacetic acid, diethylenethioetherdiaminetetraacetic acid, glycol etherdiaminetetraacetic acid, diethylenetriaminepentaacetic acid, cyclohexanediaminetetraaceticacid, ethylenediamine-N-di-carboxyphenyl-N,N'N'-triacetic acid, iminodiacetic acid, methyliminodiacetic acid, N-(2-carboxyphenyl) iminodiacetic acid, and N-(2-acetamide)iminodiacetic acid. In addition thereto, there can preferably be used as well, organic acid metal complex salts described in JP-A-63-80256, JP-A-63-97952, JP-A-63-97953, JP-A-63-97954, JP-A-1-93740, Jp-A-3-144446, JP-A-3-216650, and Jp-A-3-180842, European Patent Publica-tions 458131A1, 461413A1, 461676A1, 468325, 430000A1, 501479, and 520457A2, German Patent Publication 3912551, and Jp-A-4-337729, JP-A-4-73647, and Jp-A-4-174432. The bleaching agent in a processing solution having a bleaching ability may be used either singly or in combination of two or more kinds.

In general, ammonium thiosulfate has been used as a fixing agent in a bleach-fixing solution or a fixing solution but it may be replaced with the other publicly known fixing agents, for example, a mesoionic series compound, a thioether series compound, thioureas, iodide in a large volume, and hypo. These are described in Jp-A-60-61749, Jp-A-60-147735, JP-A-64-21444, JP-A-1-201659, Jp-A-1-210951, and Jp-A-2-44355, and U.S. Pat. No. 4,378,424.

With respect to a washing or stabilizing process applied in the present invention, a stabilizing solution described in U.S. Pat. No. 4,786,583 can be enumerated. Formaldehyde is used for stabilizing in the stabilizing solution, and preferred from a viewpoint of a working environmental safety are N-methylolazole, hexamethlenetetramine, m-hydroxybenzaldehydes, a formaldehyde bisulfite adduct, dimethylolurea, and an azolylmethyl-amine derivative. These are described in JP-A-2-153348, JP-A-5-34889, JP-A-4-270344, and JP-A-4-313752. In particular, preferably used in combination are azoles such as 1,2,4-triazole, and azolylmethylamine and the derivative thereof, such as 1,4-bis(1,2,4-triazole-1-ylmethyl) piperazine (described in JP-A-4-359249) since an image stability is high and a vapor pressure of formaldehyde is low.

The present invention will concretely be explained below with reference to the examples but not limited thereto.

EXAMPLE 1

A paper support laminated on the both sides thereof with polyethylene, which was subjected to a corona discharge treatment, was provided with a gelatin subbing layer containing sodium dodecylbenzenesulfonate and further was coated with the various photographic constitutional layers, whereby the multilayered color photographic paper (Sample 101) having the layer constitution shown below was prepared. The coating solutions were prepared in the following manner.

Preparation of the first layer-coating solution

The yellow coupler (ExY-1) 153.0 g, the dye image stabilizer (Cpd-1) 15.0 g, the dye image stabilizer (Cpd-2) 7.5 g, and the dye image stabilizer (Cpd-3) 16.0 g were dissolved in the solvent (Solv-1) 25 g, the solvent (Solv-5) 25 g and ethyl acetate 180.0 ml, and this solution was emulsified and dispersed in a 10% gelatin aqueous solution 1000 g containing a 10% sodium dodecylbenzenesulfonate aqueous solution 60 ml and citric acid 10 g to thereby prepare the emulsified dispersion A. On the other hand, there was prepared the silver bromochloride emulsion A (cube, the 3:7 mixture (silver mole ratio) of a large size emulsion A with an average grain size of 0.88 μm and a small size emulsion A with an average grain size of 0.70 μm, wherein the fluctuation coefficients in the grain size distributions were 0.08 and 0.10, respectively, and either size emulsions contained silver bromide 0.3 mol % localized on a part of a grain surface). The blue-sensitive sensitizing dyes A and B shown below were added to this emulsion in the amounts of $2.0\times10^{-4}$ mole per mole of silver to the large size emulsion A and $2.5\times10^{-4}$ mole per mole of silver to the small size emulsion A, respectively. Then, this emulsion was subjected to a chemical sensitization by adding a sulfur sensitizer and a gold sensitizer. The foregoing emulsified dispersion A and this silver bromochloride emulsion A were mixed and dissolved, whereby the first layer coating solution was prepared so that it was of a composition described later. An emulsion coated amount is represented in terms of a coated amount converted to a silver amount.

The coating solutions for the second layer to seventh layer were prepared in the same manner as that in the first layer coating solution. Sodium 1-oxy-3,5-dichloro-s-triazine was used as a gelatin hardener for the respective layers. Further, Cpd-14 and Cpd-15 were added to the respective layers so that the total amounts thereof became 25.0 mg/m$^2$ and 50.0 mg/m$^2$, respectively.

The following spectral sensitizing dyes were used for the silver bromochloride emulsions contained in the respective light-sensitive emulsion layers:

Blue-sensitive emulsion layer

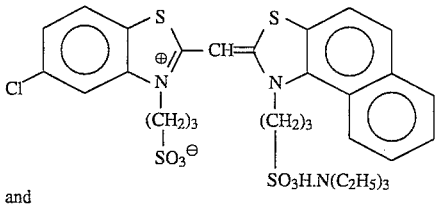

Sensitizing dye A and

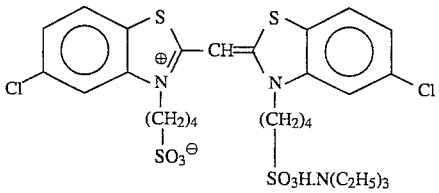

Sensitizing dye B (each $2.0\times10^{-4}$ mole per mole of silver halide to the large size emulsion and each $2.5\times10^{-4}$ mole per mole of silver halide to the small size emulsion).

Green-sensitive emulsion layer

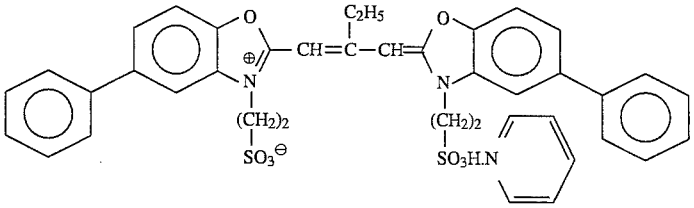

Sensitizing dye C ($4.0\times10^{-4}$ mole per mole of silver halide to the large size emulsion and $5.6\times10^{-4}$ mole per mole of silver halide to the small size emulsion)

Sensitizing dye D

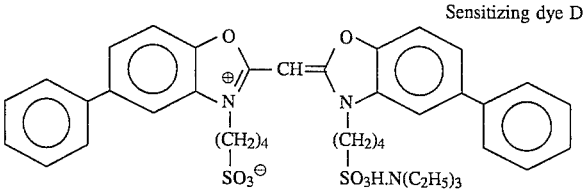

($7.0\times10^{-5}$ mole per mole of silver halide to the large size emulsion and $1.0\times10^{-4}$ mole per mole of silver halide to the small size emulsion).

Red-sensitive emulsion layer

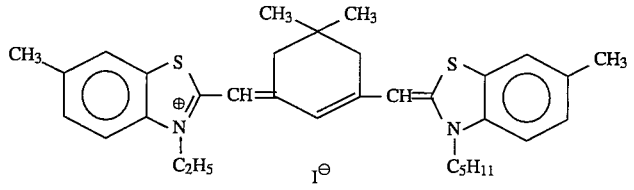

Sensitizing dye E ($0.9\times10^{-4}$ mole per mole of silver halide to the large size emulsion and $1.1\times10^{-4}$ mole per mole of silver halide to the small size emulsion)

Further, the following compound F was added to the red-sensitive layer in the amount of $2.6\times10^{-3}$ mole per mole of silver halide:

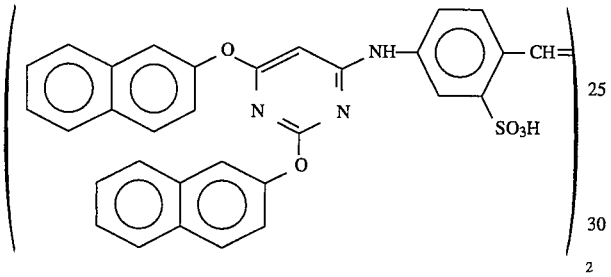

Further, 1-(5-methylureidophenyl)-5-mercapto-tetrazole was added to the blue-sensitive emulsion layer, the green-sensitive emulsion layer and the red-sensitive emulsion layer in the amounts of $8.5\times10^{-5}$ mole, $7.7\times10^{-4}$ mole and $2.5\times10^{-4}$ mole per mole of silver halide, respectively. Further, 4-hydroxy-6-methyl-1,3,3a,7-tetrazaindene was added to the bluesensitive emulsion layer and the green-sensitive emulsion layer in the amounts of $1\times10^{-4}$ mole and $2\times10^{-4}$ mole per mole of silver halide, respectively.

Further, the following dyes (a coated amount was shown in a parenthesis) were added to the emulsion layers for preventing irradiation.

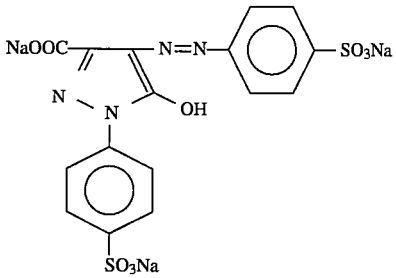

(10 mg/m²)

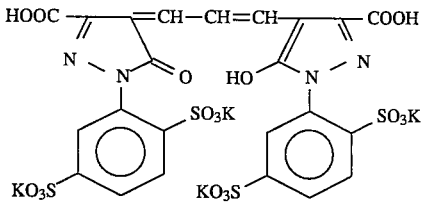

(10 mg/m²)

-continued

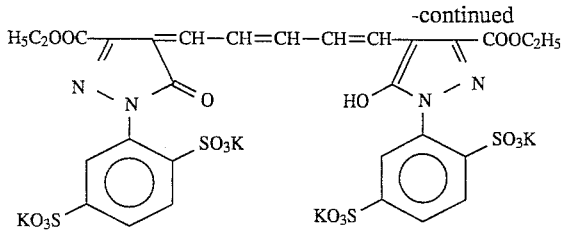

(40 mg/m²)

and

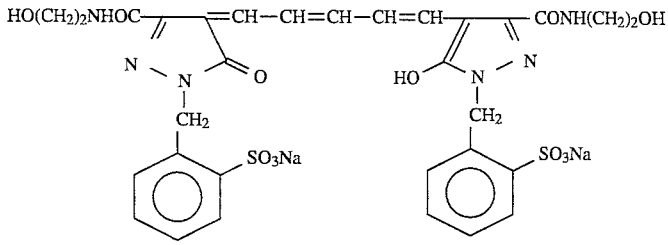

(20 mg/m²)

Layer constitution

The compositions of the respective layers are shown below. The numerals represent the coated amounts (g/m²). The coated amounts of the silver halide emulsions are expressed in terms of the amounts converted to silver.

| | |
|---|---|
| Support: | |
| Polyethylene-laminated paper [polyethylene coated on the 1st layer side contains a white pigment (titanium oxide) and a blue dye (ultramaine)]. | |
| First layer (a blue-sensitive emulsion layer): | |
| Above silver bromochloride emulsion A | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second layer (an anti-color mixing layer): | |
| Gelatin | 1.00 |
| Anti-color mixing agent (Cpd-4) | 0.06 |
| Solvent (Solv-7) | 0.03 |
| Solvent (Solv-2) | 0.25 |
| Solvent (Solv-3) | 0.25 |
| Third layer (a green-sensitive emulsion layer): | |
| Silver bromochloride emulsion (cube, 1:3 mixture (Ag mole ratio) of the large size emulsion B having an average grain size of 0.55 mm and the small size emulsion B having an average grain size of 0.39 mm, wherein the fluctuation coefficients in the grain size distributions were 0.10 and 0.08, respectively, and either size emulsions contained silver bromide of 0.8 mol % localized on a part of the grain surface) | 0.13 |
| Gelatin | 1.45 |
| Magenta soupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |

-continued

| | |
|---|---|
| Fourth layer (an anti-color mixing layer): | |
| Gelatin | 0.70 |
| Anti-color mixing agent (Cpd-4) | 0.04 |
| Solvent (Solv-7) | 0.02 |
| Solvent (Solv-2) | 0.18 |
| Solvent (Solv-3) | 0.18 |
| Fifth layer (a red-sensitive emulsion layer): | |
| Silver bromochloride emulsion (cube, 1:3 mixture (Ag mole ratio) of the large size emulsion C having an average grain size of 0.50 mm and the small size emuslion C having an average grain size of 0.41 mm, wherein the fluctuation coefficients in the grain size distributions were 0.09 and 0.11, respectively, and either size emulsions contained silver bromide of 0.8 mol % localized on a part of the grain surface) | 0.20 |
| Gelatin | 0.85 |
| Cyan coupler (ExC) | 0.33 |
| UV absorber (UV-2) | 0.18 |
| Dye image stabilizer (Cpd-1) | 0.33 |
| Dye image stabilizer (Cpd-9) | 0.02 |
| Dye image stabilizer (Cpd-10) | 0.02 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Sixth layer (a UV absorbing layer): | |
| Gelatin | 0.55 |
| UV absorber (UV-1) | 0.38 |
| Dye image stabilizer (Cpd-12) | 0.15 |
| Dye image stabilizer (Cpd-5) | 0.02 |
| Seventh layer (a protective layer): | |
| Gelatin | 1.13 |
| Acryl-modified copolymer of polyvinyl alcohol (a modification degree: 17%) | 0.05 |
| Liquid paraffin | 0.02 |
| Dye image stabilizer (Cpd-13) | 0.01 |

-continued (ExY) Yellow coupler

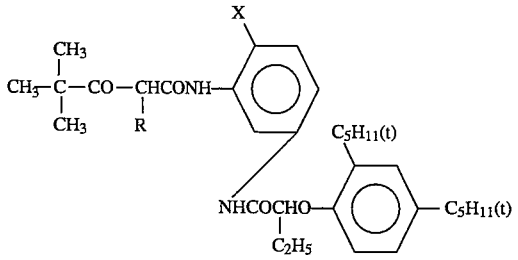

1:1 Mixture (mole ratio) of:

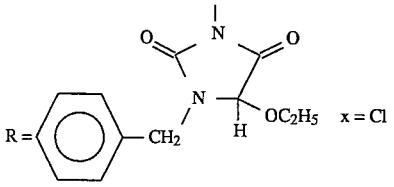

and

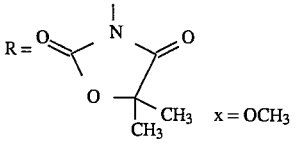

(ExM) Magenta coupler (Exemplified Coupler M-22)

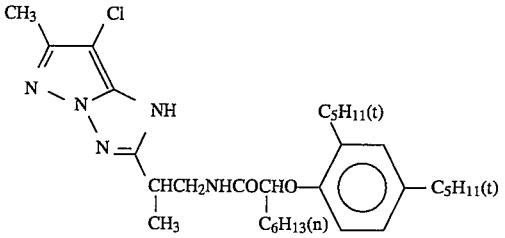

(ExC) Cyan coupler
3:7 mixture (mole ratio) of

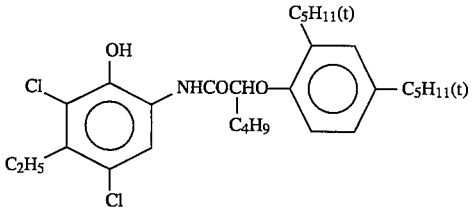

and

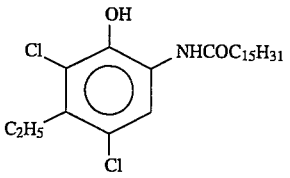

(Cpd-1) Dye image stabilizer $\text{-}(CH_2-CH)_n\text{-}$
$CONHC_4H_9(t)$
average molecular weight: 60,000

-continued (Cpd-2) Dye image stabilizer

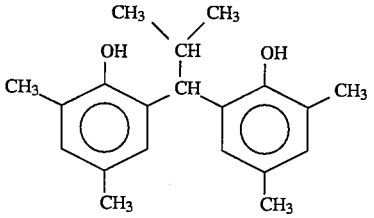

(Cpd-3) Dye image stabilizer

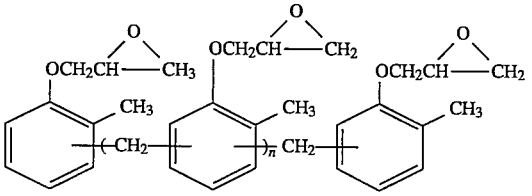

n = 7 to 8 (average value)

(Cpd-4) Anti-color mixing agent

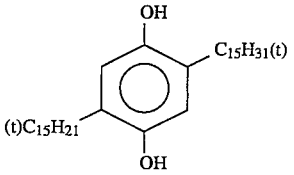

(mixture of side chain isomers)

(Cpd-5) Dye image stabilizer

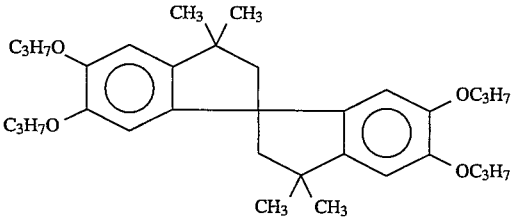

(Cpd-6) Dye image stabilizer

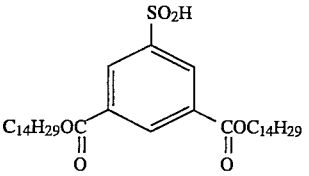

(Cpd-7) Dye image stabilizer

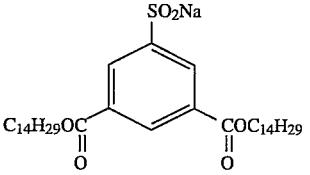

-continued
(Cpd-8) Dye image stabilizer
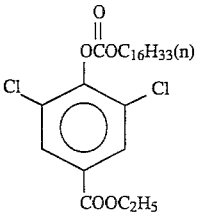
(Cpd-9) Dye image stabilizer
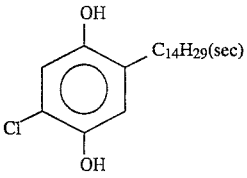
(Cpd-10) Dye image stabilizer
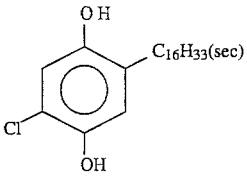
(Cpd-11) Dye image stabilizer
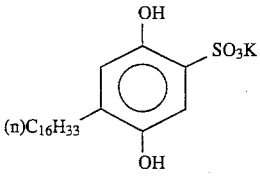
(Cpd-12) Dye image stabilizer
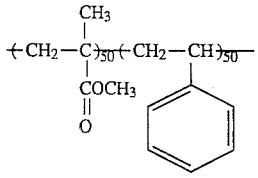
(Cpd-13) Dye image stabilizer
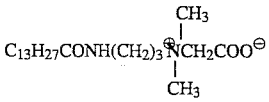
(Cpd-14) Preservative
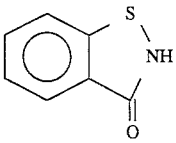
(Cpd-15) Preservative
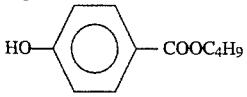
(Solv-1) Solvent
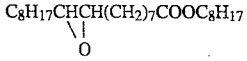
-continued
(Solv-2) Solvent
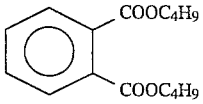
(Solv-3) Solvent
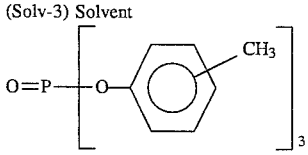
(Solv-4) Solvent
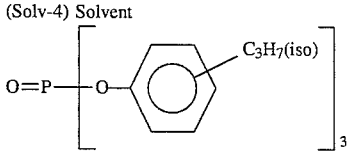
(Solv-5) Solvent
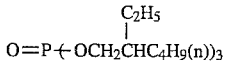
(Solv-6) Solvent
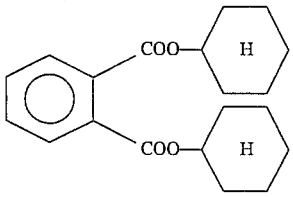
(Solv-7) Solvent
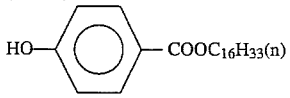
(UV-1) UV absorber
1:5:10:5 mixture (weight ratio) of:
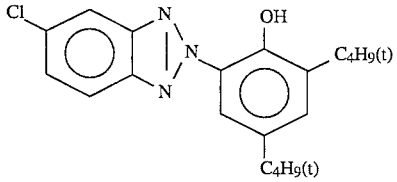
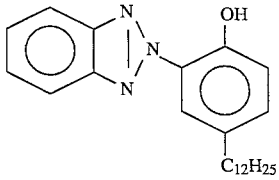
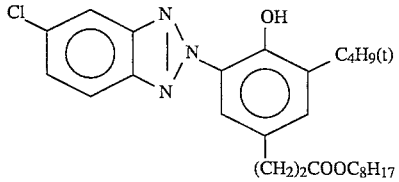

-continued

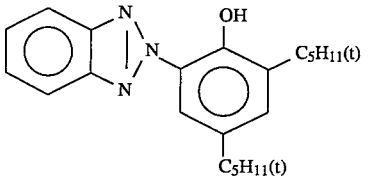

(UV-2) UV absorber
1:2:2 mixture (weight ratio) of:

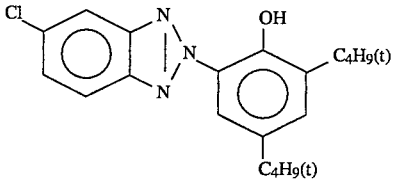

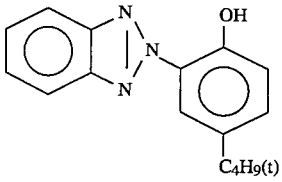

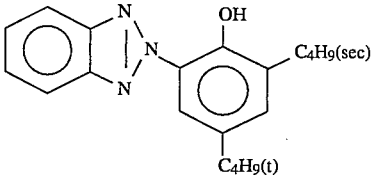

Next, Samples 102 to 125 were prepared in the same manner as Sample 101, except that the anti-color mixing agent (Cpd-4) contained in the second layer and the fourth layer and the magenta coupler (ExM) contained in the third layer were replaced with the same moles of the compounds shown in Table A, respectively and that the compound of Formula (II) and a compound known as a toe-gradation controlling agent were added to the second layer and the fourth layer.

The samples thus prepared were exposed through an optical wedge.

The samples finishing the exposure were subjected to a continuous processing with a paper processing equipment using the following processing processes and the processing solutions of the following compositions until the replenishing solution reached twice amount as much as a tank capacity of a color developing solution bath to thereby prepare a development processing solution in a running equilibrium condition.

| Processing step | Temperature | Time | Replenishing amount* | Tank capacity |
|---|---|---|---|---|
| Color developing | 35° C. | 45 seconds | 161 ml | 17 l |
| Bleach- | 30 to 35° C. | 45 seconds | 215 ml | 17 l |
| fixing | | | | |
| Rinsing (1) | 30 to 35° C. | 20 seconds | — | 10 l |
| Rinsing (2) | 30 to 35° C. | 20 seconds | — | 10 l |
| Rinsing (3) | 30 to 35° C. | 20 seconds | 350 ml | 10 l |
| Drying | 70 to 80° C. | 60 seconds | | |

*Replenishing amount: per $m^2$ of the light-sensitive material.
Rinsing was of a three tanks countercurrent system from (3) to (2) and (2) to (1)).

are as follows:

| Color developing solution | Tank solution | Replenishing solution |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(b-methanesulfonamidethyl)-3-methyl-4-aminoaniline sulfate | 5.0 g | 7.0 g |
| N,N-bis(carboxymethyl) hydrazine | 4.0 g | 5.0 g |
| Sodium N,N-di(sulfoethyl) hydroxylamine | 4.0 g | 5.0 g |
| Fluorescent whitening agent (Whitex 4B manufactured by Sumitomo Chem. Ind.) | 1.0 g | 2.0 g |
| Water was added to | 1000 ml | 1000 ml |
| pH (25° C.) | 10.05 | 10.45 |

| Bleach-fixing solution (Common to the tank solution and the replenishing solution) | |
|---|---|
| Water | 400 ml |
| Ammonium thiosulfate (700 g/liter) | 100 ml |
| Sodium sulfite | 17 g |
| Iron (III) ammonium ethylenediamine-tetraacetate dihydrate | 55 g |
| Disodium ethylenediminetetracetate dihydrate | 5 g |
| Ammonium bromide | 40 g |
| Water was added to | 1000 ml |
| pH (25° C.) | 6.0 |

Rinsing solution (Common to the tank solution and the replenishing solution)

Deionized water (contents of calcium and magnesium: each 3 ppm or lower)

A part of each of the developed samples was stored in the environment of a temperature of 80° C. and a humidity of 70 RH for a week, and then it was compared for a photographic performance with a sample before storage. The evaluation of the photographic performance was carried out for a gradation (an average gradation in a density of Dmin+0.1 to a concentration of Dmin+0.6). The results are shown in Table A.

TABLE A

| Sample | Additives to second layer and fourth layer: Compound of Formula (I) or anti-color mixing agent | Compound of Formula (II) or toe-cutting agent | Addition* mole ratio | Magenta coupler in 3rd layer | Gradation* | Gradation after storage |
|---|---|---|---|---|---|---|
| 101 (Comp.) | Cpd-4 | — | — | ExM | 1.68 | 1.63 |
| 102 (Comp.) | I-A | — | — | ExM | 1.63 | 1.59 |
| 103 (Comp.) | I-A | II-2 | 30 | ExM | 1.71 | 1.54 |
| 104 (Inv.) | I-2 | II-1 | 30 | ExM | 2.03 | 1.97 |
| 105 (Inv.) | I-6 | II-9 | 30 | ExM | 2.00 | 1.82 |
| 106 (Comp.) | I-B | — | 30 | M-A | 1.62 | 1.61 |
| 107 (Comp.) | I-B | II-2 | 30 | M-A | 1.75 | 1.52 |
| 108 (Inv.) | Cpd-4 | II-2 | 30 | M-A | 2.01 | 1.95 |
| 109 (Inv.) | Cpd-4 | II-3 | 30 | M-A | 1.97 | 1.90 |
| 110 (Comp.) | I-10 | II-10 | 5 | M-4 | 1.76 | 1.62 |
| 111 (Inv.) | I-10 | II-10 | 15 | M-4 | 2.09 | 2.05 |
| 112 (Inv.) | I-10 | II-10 | 30 | M-4 | 2.25 | 2.21 |
| 113 (Inv.) | I-10 | II-10 | 40 | M-4 | 2.28 | 2.23 |
| 114 (Inv.) | I-10 | II-10 | 60 | M-4 | 2.28 | 2.21 |
| 115 (Inv.) | I-10 | II-10 | 80 | M-4 | 2.29 | 2.18 |
| 116 (Inv.) | I-10 | II-10 | 100 | M-4 | 2.30 | 2.10 |
| 117 (Comp.) | I-10 | II-10 | 120 | M-4 | 2.30 | 1.86 |
| 118 (Comp.) | I-11 | — | — | M-4 | 1.65 | 1.61 |
| 119 (Comp.) | I-11 | I-B | 30 | M-4 | 1.83 | 1.45 |
| 120 (Inv.) | I-11 | II-11 | 30 | M-4 | 2.13 | 2.08 |
| 121 (Comp.) | I-10 | — | — | M-7 | 1.69 | 1.63 |
| 122 (Comp.) | I-10 | II-10 | 5 | M-7 | 1.82 | 1.65 |
| 123 (Inv.) | I-10 | II-10 | 30 | M-7 | 2.21 | 2.19 |
| 124 (Inv.) | I-10 | 11-10 | 80 | M-7 | 2.30 | 2.11 |
| 125 (Comp.) | I-11 | II-A | 30 | M-7 | 1.81 | 1.42 |
| 126 (Inv.) | I-10 | II-10 | 30 | M-2 | 2.22 | 2.19 |
| 127 (Inv.) | I-10 | II-10 | 30 | M-3 | 2.20 | 2.18 |
| 128 (Inv.) | I-10 | II-10 | 30 | M-9 | 2.19 | 2.18 |
| 129 (Inv.) | I-2 | II-15 | 30 | M-4 | 2.14 | 2.10 |
| 130 (Inv.) | I-13 | II-12 | 30 | M-4 | 2.15 | 2.11 |
| 131 (Inv.) | I-12 | II-7 | 15 | M-4 | 2.07 | 2.02 |
| 132 (Inv.) | I-9 | II-6 | 30 | M-5 | 2.11 | 2.09 |
| 133 (Inv.) | Cpd-4 | II-11 | 30 | M-5 | 2.16 | 2.13 |

*(Compound of Formula (II) or toe-gradation controlling agent/compound of Formula (I) or anti-color mixing agent (mole %).
**Average gradation in a concentration of Dmin + 0.1 to a concentration of Dmin + 0.6.

Comparative anti-color mixing agent

I-A

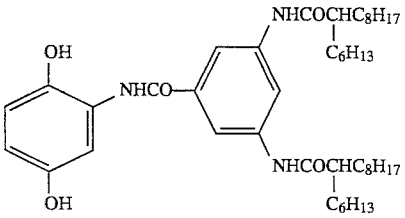

I-B

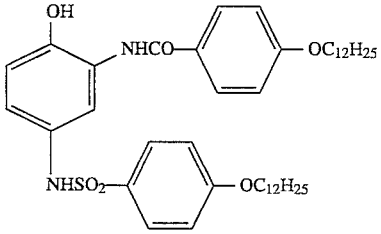

-continued

Comparative toe-gradation controlling agent

II-A

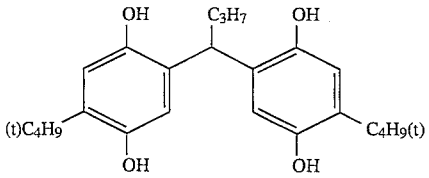

II-B

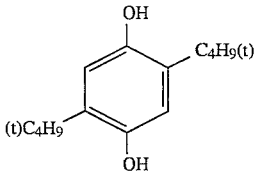

-continued

Magenta coupler

M-A

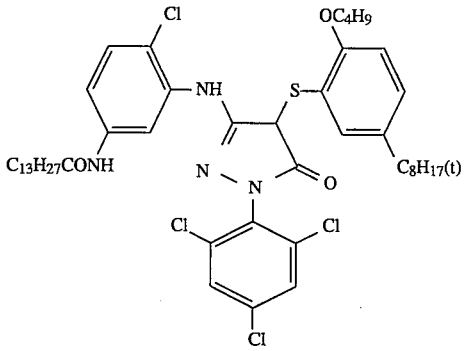

As apparent from the results summarized in Table A, the samples in which the compound of Formula (I) and the compound of Formula (II) each of the present invention were combined showed an excellent gradation as compared with the comparative samples. Further, it can be found that in the case where the coupler of Formula (M) was used as a magenta coupler and further in the case where the coupler of Formula (M-I) was used, the effects thereof were marked.

The fatigued processing solutions used for continuously processing Samples 119 and 125 were used to process Samples 119 and 125, respectively to find that the photographic performances were notably different from those obtained with a fresh solution. Meanwhile, it was found as well that Sample 112 processed in a fatigued solution used for continuously processing Sample 112 showed the same photographic performance as that with the fresh solution and that the samples in which the compound of Formula (I) and the compound of Formula (II) each of the present invention were combined provided less processing solution contamination.

In Sample 119, a sensitivity of a cyan color-developing layer was apparently lowered as compared with those of the other samples.

EXAMPLE 2

The same Sample 201 as Sample 101 described in JP-A-3-223752 was prepared. Then, Samples 202 to 204 were prepared in the same manner as that in Sample 201, except that the compound (Cpd-2) contained in the 11th layer and the 12th layer of Sample 201 was replaced with the same molar amounts of Mix 1 to 3 of the exemplified compounds of the present invention.

Mix 1 I-10: II-10=3:1 (mole ratio)

Mix 2 I-2: II-2=3:1 (mole ratio)

Mix 3 I-7: II-7=3:1 (mole ratio)

These samples were subjected to an imagewise exposure and then to a color development processing in the conditions described in Example 1 of JP-A-3-223752. The yellow fog densities of the samples after the development were measured to confirm that the fog densities of Sample 202 to 205 were obviously small as compared with that of Sample 201.

EXAMPLE 3

The same Sample 301 as the light-sensitive sheet A described in Example 1 of JP-A-1-154151 was prepared. Then, Samples 302 to 304 were prepared in the same manner as that in Sample 301, except that 2,5-di-t-pentadecylhydroquinone contained in the first layer, the 4th layer and the 7th layer of Sample 301 was replaced with the same molar amounts of Mix 1 to 3 of the exemplified compounds of the present invention described in Example 2 described above.

These samples were subjected to an imagewise exposure and then to a development processing described in Example 1 of JP-A-1-154151 to confirm that the whiteness degrees of Samples 302 to 304 after the development were obviously excellent as compared with that of Sample 301.

EXAMPLE 4

The same Sample 401 as Sample 301 described in Example 4 of JP-A-1-154151 was prepared. Then, Samples 402 to 404 were prepared in the same manner as that in Sample 401, except that the compound 1-12 contained in the 2nd layer, the 8th layer, the 13th layer and the 17th layer of Sample 401 was replaced with the same molar amounts of Mix 1 to 3 of the exemplified compounds of the present invention described in above Example 2.

These samples were subjected to an imagewise exposure and then to a development processing described in Example 4 of JP-A-1-154151 to confirm that the whiteness degrees of Samples 402 to 404 after the development were obviously excellent as compared with that of Sample 401.

The embodiment of the present invention can improve a background stain and a gradation fluctuation in a silver halide color light-sensitive material and a processing solution contamination.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support provided thereon at least one light sensitive silver halide emulsion layer and at least one light insensitive layer, wherein said at least one light insensitive layer contains at least one of the compounds represented by Formula (I) and at least one of the compounds represented by Formula (II); and the amount of the compounds represented by Formula (II) in said at least one light insensitive layer is 15 to 100 mole % of the amount of the compounds represented by Formula (I) in the same light insensitive layer:

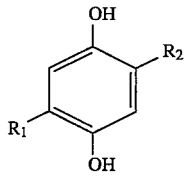

(I)

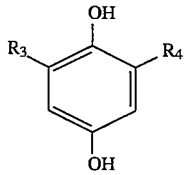

(II)

wherein $R_1$, $R_2$, $R_3$ and $R_4$ are the same or different and each represents an alkyl group, provided that a total number of carbon atoms in $R_1$ and $R_2$ is 16 to 60, and a total number of carbon atoms in $R_3$ and $R_4$ is 16 to 60, and that none of $R_1$, $R_2$, $R_3$ and $R_4$ contains a hydroquinone structure.

2. The silver halide color photographic material according to claim 1, wherein a coupler contained in a light-sensitive silver halide emulsion layer adjacent to said at least one light insensitive layer containing at least one of the compounds represented by Formula (I) and at least one of the compounds represented by Formula (II) is a coupler represented by Formula (M):

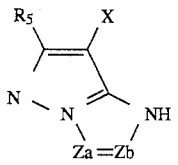

(M)

wherein $Z_a$ and $Z_b$ each represent =C($R_6$)— or =N—; $R_5$ and $R_6$ each represent a substituent; and X represents a hydrogen atom or a group capable of splitting off upon a coupling reaction with a an oxidation product of a color developing agent.

3. The silver halide color photographic material according to claim 2, wherein $R_5$ in Formula (M) is

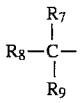

wherein $R_7$, $R_8$ and $R_9$ are the same or different and each represents a substituent selected from the group consisting of a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imide group, a heterocyclic thio group, a sulfinyl group, a phosphonyl group, an aryloxycarbonyl group, an acyl group, and an azolyl group.

4. The silver halide color photographic material according to claim 1, wherein $R_1$, $R_2$, $R_3$ and $R_4$ each represents an unsubstituted alkyl group.

5. The silver halide color photographic material according to claim 1, wherein $R_1$ and $R_2$ are the same alkyl group, and $R_3$ and $R_4$ are the same alkyl group.

6. The silver halide color photographic material according to claim 5, wherein the same alkyl groups for $R_1$ and $R_2$, and $R_3$ and $R_4$ are secondary or tertiary alkyl groups.

7. The silver halide color photographic material according to claim 5, wherein the same alkyl groups for $R_1$ and $R_2$, and $R_3$ and $R_4$ are secondary alkyl groups.

8. The silver halide color photographic material according to claim 1, wherein said at least one light insensitive layer is an intermediate layer adjacent to a magenta color-developing light-sensitive silver halide emulsion layer.

9. The silver halide color photographic material according to claim 1, wherein the content of the compounds represented by formula (I) falls within the range of $1\times10^{-8}$ mole/$m^2$ to $1\times10^{-2}$ mole/$m^2$ in said at least one light insensitive layer.

10. The silver halide color photographic material according to claim 1, wherein the content of the compounds represented by formula (II) falls within the range of $1\times10^{-9}$ mole/$m^2$ to $1\times10^{-2}$ mole/$m^2$ in said at least one light insensitive layer.

11. The silver halide color photographic material according to claim 1, the amount of the compound represented by Formula (II) in said at least one light insensitive layer is 20 to 80 mole % of the amount of the compounds represented by Formula (I) in the same light insensitive layer.

12. The silver halide color photographic material according to claim 1, the amount of the compound represented by Formula (II) in said at least one light insensitive layer is 25 to 60 mole % of the amount of the compounds represented by Formula (I) in the same light insensitive layer.

13. The silver halide color photographic material according to claim 3, wherein said coupler represented by Formula (M) is a coupler represented by Formula (M-I-a) or Formula (M-I-b)

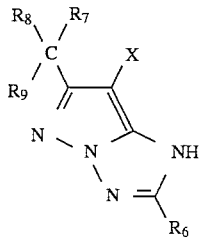

(M-I-a)

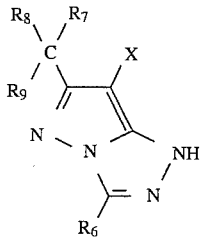

(M-I-b)

wherein X and $R_6$ each has the same definition as those in Formula (M); and $R_7$, $R_8$ and $R_9$ has the same definition as in claim 3.

14. The silver halide color photographic material according to claim 2, wherein $R_5$ and $R_6$ each represents a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imide group, a heterocyclic thio group, a sulfinyl group, a phosphonyl group, an aryloxycarbonyl group, an acyl group, or an azolyl group.

15. The silver halide color photographic material according to claim 2, wherein the coupler is used in an amount of 0.003 to 0.3 mole per mole of the light-sensitive silver halide contained in the same light-sensitive silver halide emulsion layer.

16. The silver halide color photographic material according to claim 1, wherein the amount of the compounds represented by Formula (II) in said at least one light insensitive layer is 25 to 60 mole % of the amount of the compounds represented by Formula (I) in the same light insensitive layer.

17. The silver halide color photographic material according to claim 2, wherein $R_5$ and $R_6$ each represents an alkyl group, an aryl group, an anilino group, an acylamino group, a sulfonamide group, an alkoxy group, an alkylthio group, or an arylthio group.

18. The silver halide color photographic material according to claim 3, wherein $R_7$, $R_8$ and $R_9$ each represents an alkyl group, an aryl group, an anilino group, an acylamino group, a sulfonamide group, an alkoxy group, an alkylthio group, or an arylthio group.

19. The silver halide color photographic material according to claim 5, wherein $R_1$ and $R_2$ both represent an alkyl substituted with a halogen atom, a hydroxyl group, or an alkoxycarbonyl group.

20. The silver halide color photographic material according to claim 5, wherein $R_3$ and $R_4$ both represent an alkyl substituted with a halogen atom, a hydroxyl group, or an alkoxycarbonyl group.

* * * * *